US009172144B2

(12) United States Patent
Tatarnikov et al.

(10) Patent No.: US 9,172,144 B2
(45) Date of Patent: Oct. 27, 2015

(54) PATCH ANTENNA WITH CAPACITIVE ELEMENTS

(71) Applicant: Topcon GPS, LLC, Oakland, NJ (US)

(72) Inventors: Dmitry Tatarnikov, Moscow (RU); Andrey Astakhov, Moscow (RU); Anton Stepanenko, Dedovsk (Moscow Region) (RU); Pavel Shamatulsky, Moscow (RU)

(73) Assignee: Topcon GPS, LLC, Oakland, NJ (US)

( * ) Notice: Subject to any disclaimer, the term of this patent is extended or adjusted under 35 U.S.C. 154(b) by 350 days.

(21) Appl. No.: 13/713,350

(22) Filed: Dec. 13, 2012

(65) Prior Publication Data

US 2014/0009349 A1 Jan. 9, 2014

Related U.S. Application Data

(63) Continuation of application No. 12/275,761, filed on Nov. 21, 2008, now Pat. No. 8,446,322.

(60) Provisional application No. 61/004,744, filed on Nov. 29, 2007.

(51) Int. Cl.
*H01Q 9/00* (2006.01)
*H01Q 9/04* (2006.01)

(52) U.S. Cl.
CPC ..... *H01Q 9/0428* (2013.01); *H01Q 9/0414* (2013.01); *H01Q 9/0442* (2013.01); *H01Q 9/0471* (2013.01)

(58) Field of Classification Search
CPC ..... H01Q 9/00; H01Q 1/24; H01Q 1/38
USPC ..... 343/749, 702, 700 MS, 846
See application file for complete search history.

(56) References Cited

U.S. PATENT DOCUMENTS

| | | | | |
|---|---|---|---|---|
| 6,166,692 | A * | 12/2000 | Nalbandian et al. | 343/700 MS |
| 6,266,015 | B1 * | 7/2001 | Heckaman et al. | 343/700 MS |
| 6,597,316 | B2 * | 7/2003 | Rao et al. | 343/700 MS |
| 7,307,590 | B1 * | 12/2007 | Tonn | 343/700 MS |
| 7,429,952 | B2 * | 9/2008 | Sun | 343/700 MS |
| 7,605,758 | B2 * | 10/2009 | Lazar | 343/700 MS |
| 8,624,792 | B2 * | 1/2014 | Popugaev et al. | 343/833 |
| 2008/0198086 | A1 * | 8/2008 | Coupez et al. | 343/824 |

FOREIGN PATENT DOCUMENTS

| | | | |
|---|---|---|---|
| JP | 62066704 | | 3/1987 |
| JP | 2000269732 | A | 9/2000 |
| JP | 2005159944 | A | 6/2005 |
| WO | 9634426 | | 10/1996 |
| WO | 2005117208 | A1 | 8/2005 |
| WO | 2006098310 | | 9/2006 |

* cited by examiner

*Primary Examiner* — Huedung Mancuso
(74) *Attorney, Agent, or Firm* — Chiesa Shahinian & Giantomasi PC

(57) ABSTRACT

Disclosed is a micropatch antenna comprising a radiating element and a ground plane separated by an air gap. Small size, light weight, wide bandwidth, and wide directional pattern are achieved without the introduction of a high-permittivity dielectric substrate. Capacitive elements are configured along the perimeter of at least one of the radiating element and ground plane. Capacitive elements may comprise extended continuous structures or a series of localized structures. The geometry of the radiating element, ground plane, and capacitive elements may be varied to suit specific applications, such as linearly-polarized or circularly-polarized electromagnetic radiation.

10 Claims, 28 Drawing Sheets

PATCH ANTENNA WITH CAPACITIVE ELEMENTS

This application is a continuation of U.S. patent application Ser. No. 12/275,761, filed Nov. 21, 2008, which claims the benefit of U.S. Provisional Application No. 61/004,744 filed Nov. 29, 2007, both of which are incorporated herein by reference in their entirety.

BACKGROUND OF THE INVENTION

The present invention relates generally to antennas, and more particularly to patch antennas with capacitive elements.

Patch antennas are widely deployed in many devices, such as global positioning system receivers and cellular telephones, because they are small and lightweight. The basic elements of a conventional patch antenna are a flat radiating patch and a flat ground plane separated by a dielectric medium. One type of patch antenna, referred to as a microstrip antenna, may be manufactured by lithographic processes, such as those used for the fabrication of printed circuit boards. These manufacturing processes permit economical, high-volume production. More complex geometries, such as used for phased-array antennas, may also be readily manufactured.

In a common design for microstrip antennas, the ground plane and the radiating patch are fabricated from metal films deposited on or plated on a dielectric substrate. In many applications, it is desirable to have a patch antenna with a wide directional pattern and a wide operating frequency bandwidth. In the design of a microstrip antenna, there are dependencies between mechanical and electromagnetic parameters. The directional pattern increases as the size of the patch decreases. The length of a microstrip patch is equal to one-half the wavelength of the electromagnetic wave propagating in the dielectric substrate. The length of a microstrip patch may be reduced by using dielectrics with high permittivity. For antennas operating in the radiofrequency and microwave bands, however, dielectrics with high permittivities also have high densities, resulting in increased weight of the antenna. Similarly, the operating frequency bandwidth may be increased by increasing the thickness of the dielectric substrate, which again results in additional weight.

There have been various proposed designs for reducing the size and weight of patch antennas. For example, M. K. Fries and R. Vahldieck (*Small microstrip patch antenna using slow-wave structure,* 2000 IEEE International Antennas and Propagation Symposium Digest, vol. 2, pp. 770-773, July 2000) reported a microstrip patch antenna in which miniaturization is achieved by using a slow-wave circuit and a structure in the form of cross-shaped slots in the radiating patch and ground plane. Such an antenna has a simple design and light weight, but the presence of slots prevents the installation of a printed circuit board with a low-noise amplifier on the antenna, a common design architecture. What are needed are patch antennas with small size, light weight, wide directional pattern, and wide operating frequency bandwidth. Patch antennas which permit the ready integration of auxiliary electronic assemblies, such as low-noise amplifiers, are further advantageous.

BRIEF SUMMARY OF THE INVENTION

In an embodiment of the invention, a micropatch antenna comprises a radiating element and a ground plane separated by an air gap. Small size, light weight, wide bandwidth, and wide directional pattern are achieved without the introduction of a high-permittivity dielectric substrate. Capacitive elements are configured along the perimeter of at least one of the radiating element and ground plane. Capacitive elements may comprise extended continuous structures or a series of localized structures. The geometry of the radiating element, ground plane, and capacitive elements may be varied to suit specific applications, such as linearly-polarized or circularly-polarized electromagnetic radiation.

These and other advantages of the invention will be apparent to those of ordinary skill in the art by reference to the following detailed description and the accompanying drawings.

DETAILED DESCRIPTION

Figure 1:
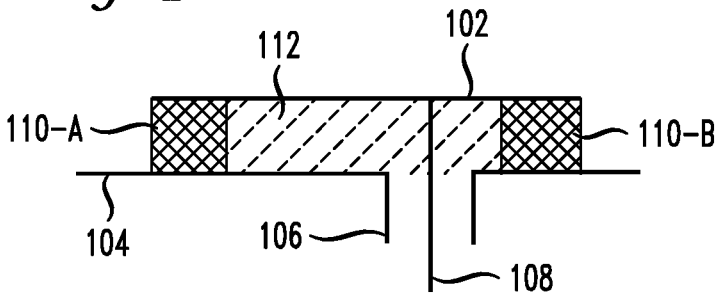
FIG. 1 shows a cross-sectional view of a patch antenna.

FIG. 1 shows a basic cross-sectional view of a conventional patch antenna. The flat radiating patch 102 is separated from the flat ground plane 104 by a dielectric medium 112. Herein, a radiating patch is also referred to as a radiating element. In the example shown, the radiating patch 102 and the ground plane 104 are held together by standoff 110-A and standoff 110-B. A standoff may be a ceramic post, for example. Dielectric medium 112, for example, may be an air gap. In other patch antenna designs, the dielectric medium 112 may be a solid dielectric. In microstrip antennas, for example, the radiating patch 102 and the ground plane 104 may be conducting films deposited on or plated onto a dielectric substrate. Since a dielectric substrate is a solid, standoff 110-A and standoff 110-B are not necessary in some designs. In microstrip antennas, complex geometries may be fabricated by photolithographic techniques, such as used in the manufacture of printed circuit boards. To simplify the terminology, herein, the term micropatch antenna refers to a patch antenna wherein the dielectric medium between the radiating patch and the ground plane may be either a dielectric substrate or air. The spacing between the radiating patch and the ground plane is equivalent to the thickness of the dielectric substrate, or to the spacing of the air gap, respectively. As shown in embodiments of the invention below, even in the absence of a dielectric substrate, the radiating patch and the ground plane of a micropatch antenna may be fabricated with complex geometries.

Signals are transmitted to and from the patch antenna via a radiofrequency (RF) transmission line. In the example shown in FIG. 1, signals are fed to the radiating patch 102 via a coaxial cable. The outer conductor 106 is electrically connected to the ground plane 104, and the center conductor 108 is electrically connected to the radiating patch 102. Electromagnetic signals are fed to the radiating patch 102 via the center conductor 108. Electrical currents are induced on both the radiating patch 102 and the ground plane 104. The size of the radiating patch 102 is a function of the wavelength being propagated in the dielectric medium 112 between the radiating patch 102 and the ground plane 104. In a microstrip antenna, for example, the length of the microstrip is equal to one half of the wavelength. The width of the antenna directional pattern is in turn a function of the size of the radiating patch 102. In a microstrip antenna, for example, the width of the directional pattern increases as the length of the microstrip decreases.

One way to simultaneously reduce the antenna size and increase the directional pattern is to decrease the wavelength in the dielectric medium 112 between the radiating patch 102 and the ground plane 104. The wavelength may be decreased by choosing a dielectric medium with a high value of permittivity (also referred to as dielectric constant). In a microstrip antenna, for example, the wavelength decreases by a factor of $\sqrt{\in}$, where $\in$ is the permittivity in the dielectric medium; consequently, the resonant size of microstrip antenna decreases by a factor of $\sqrt{\in}$. At radio and microwave frequencies, however, dielectric materials with high values of permittivity have high densities, and, therefore, increase the weight of the patch antenna.

High-permittivity dielectric materials also degrade performance because the operating frequency bandwidth decreases with increasing values of $\in$. The operating frequency bandwidth is also a function of the distance between the radiating patch 102 and the ground plane 104. The operating frequency increases as the distance increases. In a microstrip antenna, for example, the operating frequency bandwidth may be increased by increasing the thickness of the dielectric substrate. Improving the performance, however, once again increases the weight of the patch antenna.

Figure 2:
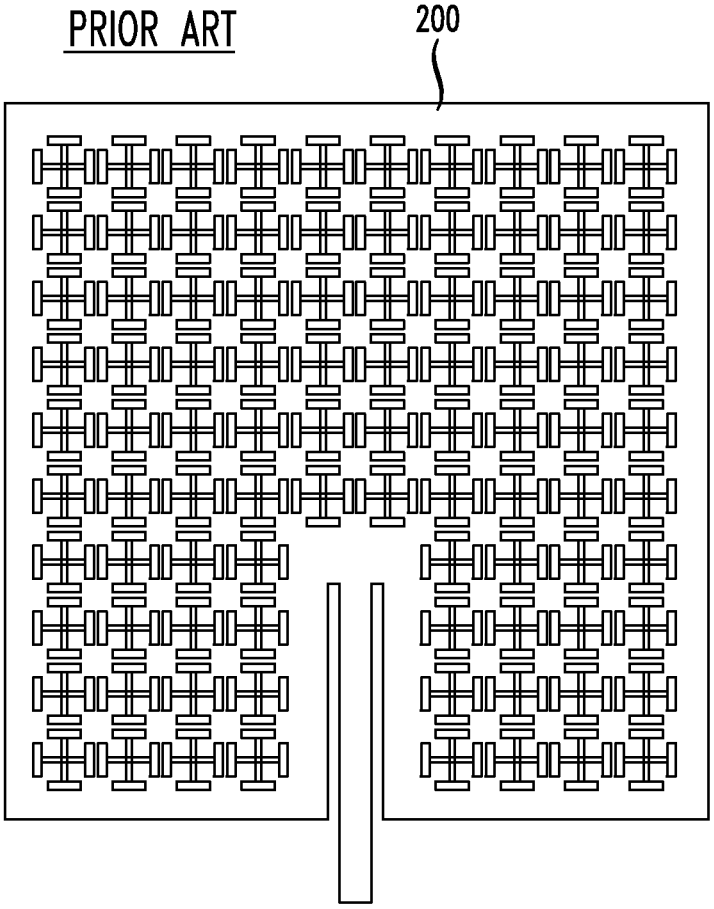
FIG. 2 PRIOR ART
FIG. 2 shows an overhead view of a prior-art patch antenna with slots on the radiating element.

There have been various proposed designs for reducing the size and weight of patch antennas. For example, M. K. Fries and R. Vahldieck (*Small microstrip patch antenna using slow-wave structure,* 2000 IEEE International Antennas and Propagation Symposium Digest, vol. 2, pp. 770-773, July 2000) reported a microstrip patch antenna in which miniaturization is achieved by using a slow-wave circuit and a structure in the form of cross-shaped slots in the radiating patch and the ground plane. A top view of their microstrip patch antenna 200 is shown in FIG. 2. Such an antenna has a simple design and light weight, but the presence of slots prevents the installation of a printed circuit board with a low-noise amplifier on the antenna, a common design architecture.

In an embodiment of the present invention, the dimensions of the radiating patch are decreased without introducing a high-permittivity solid dielectric medium between the radiating patch and the ground plane. To estimate the frequency response of microstrip antennas in a linear polarization mode, a model in the form of a short-circuited segment of a microstrip line may be used. When the length of the segment is smaller than a quarter wavelength, there arises a transverse wave (T-wave). The segment is loaded to evaluate the radiation conductivity of a slot formed by the radiating patch edge and the ground plane. This structure may be considered as a loaded resonator, whose operating bandwidth is determined by its Q-factor. An actual microstrip antenna is normally a half-wave resonator, but the Q-factor estimation made on the basis of the short-circuited quarter wavelength resonator still holds because the reactive power and the radiation resistance are one half of the corresponding values in a half-wave transmission line.

Figure 3:
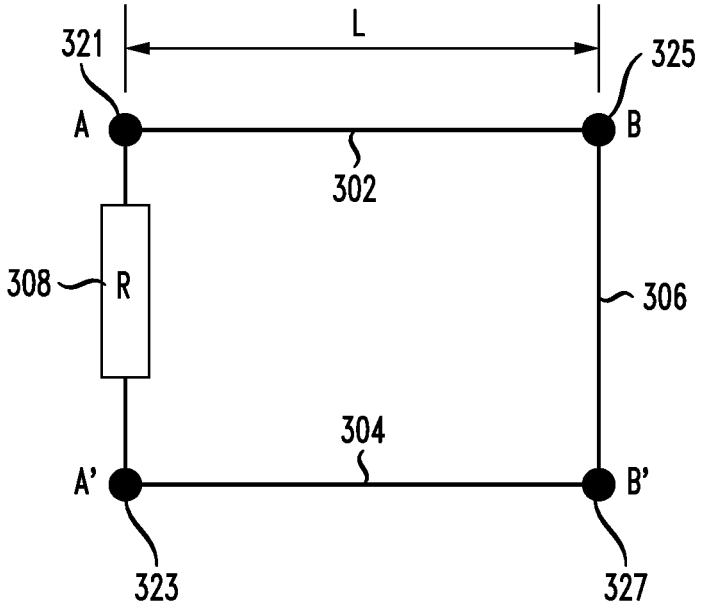
FIG. 3 shows an equivalent circuit of a linearly-polarized antenna modelled as a microstrip line.

In FIG. 3, the equivalent circuit is shown in the form of a strip line with length L. The two sides of the strip line are line 302 (running from node A 321 to node B 325) and line 304 (running from node A' 323 to node B' 327). One end, running from node B 325 to node B' 327, is a short circuit 306. The other end, running from node A 321 to node A' 323, is loaded with a resistance R 308.

The wave resistance is denoted by W, and the wave-slowing factor is denoted by $\beta$. The parameter $\beta$ is related to $\in_{eff}$, the effective permittivity (also referred to as the effective dielectric constant) of the substrate, by $$\beta=\sqrt{\in_{eff}}, \tag{E1}$$

The input admittance Y across node A 321 and node A' 323 is given by $$Y = G - \frac{i}{W} ctg\gamma L = G + iB(\omega), \tag{E2}$$

where G is the conductance and B is the susceptance, with $$G = \frac{1}{R}. \tag{E3}$$

The propagation phase constant is $$\gamma = \frac{\omega}{c}\beta, \tag{E4}$$

where ω is the angular frequency, and c is the speed of light in vacuum. The cotangent function is abbreviated as ctg.

In the vicinity of the resonance frequency $\omega_0$, $$B(\omega_0) = 0 \tag{E5}$$

$$\left[ctg\gamma L = 0 \Rightarrow \gamma L = \frac{\pi}{2}\right]$$

and $$Y \approx G + i\frac{dB}{d\omega_{\omega=\omega_0}}\Delta\omega = G + i\omega_0\frac{dB}{d\omega}\frac{\Delta\omega}{\omega_0} = G\left(1 + i2\frac{R}{2}\omega_0\frac{dB}{d\omega_{\omega=\omega_0}}\frac{\Delta\omega}{\omega_0}\right), \tag{E6}$$

where Δω is the frequency detuning (mismatch), $\Delta\omega=\omega-\omega_0$.

The Q-factor is then $$Q = \frac{R}{2}\omega_0\frac{dB}{d\omega_{\omega=\omega_0}}. \tag{E7}$$

The derivative in expression (E6) is calculated as follows:

$$\begin{aligned}\frac{dB}{d\omega_{\omega=\omega_0}} &= -\frac{d}{d\omega}\left(\frac{1}{W}ctg\gamma L\right)_{\omega=\omega_0} \\ &= -\left(\frac{1}{W}\frac{-1}{\sin^2\gamma L}L\frac{d\gamma}{d\omega}\right)_{\omega=\omega_0} \\ &= -\left(\left(\frac{1}{W}\frac{-1}{\sin^2\gamma L}L\frac{1}{c}\beta\right)_{\omega=\omega_0}\right) \\ &= \frac{1}{W}\frac{\pi}{2}\frac{1}{\omega_0}.\end{aligned} \tag{E8}$$

The Q-factor is therefore $$Q = \frac{R}{W}\frac{\pi}{4}. \tag{E9}$$

For a radiating element having a square shape, the width w is inversely proportional to the wave-slowing factor β:

$$w(\beta) = \frac{w(1)}{\beta}, \tag{E10}$$

where w(1) designates the width of a square radiating element with an air dielectric medium at β=1. The radiation resistance of a slot formed by the edge of the radiating patch and the ground plane is:

$$R(\beta) \approx 120\frac{\lambda}{w(\beta)} = 120\frac{\lambda}{w(1)}\beta, \tag{E11}$$

where λ is the wavelength in vacuum.

Neglecting edge effects, the wave resistance of the T-wave is given by the following:

$$W(\beta) \approx \frac{120\pi}{\beta}\frac{h}{w} = \frac{120\pi}{\beta}\frac{h}{w(1)}\beta = 120\pi\frac{h}{w(1)}, \tag{E12}$$

where h is the thickness of a dielectric substrate or the spacing of an air gap. Therefore, the Q-factor is $$Q = \frac{1}{4}\frac{\lambda}{h}\beta. \tag{E13}$$

Figure 4:
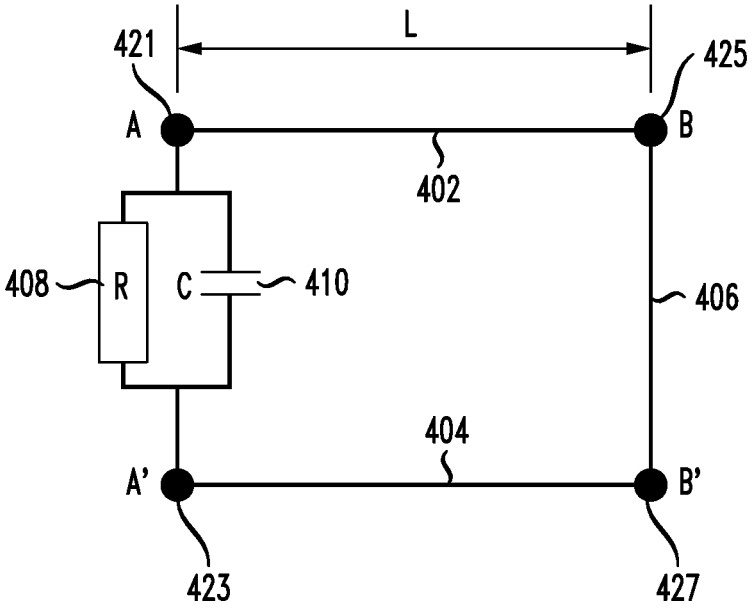
FIG. 4 shows an equivalent circuit including an end capacitor in parallel with a resistor.

FIG. 4 shows the equivalent circuit for a strip line with length L including a parallel end capacitor. The two sides of the strip line are line 402 (running from node A 421 to node B 425) and line 404 (running from node A' 423 to node B' 427). One end, running from node B 425 to node B' 427, is a short circuit 406. The other end, running from node A 421 to node A' 423, is loaded with a resistance R 408 in parallel with a capacitance C 410. The input admittance Y across node A 421 and node A' 423 is given by the following:

$$Y = G + i\omega C - \frac{i}{W}ctg\gamma L = G + i\left[\omega C - \frac{1}{W}ctg\gamma L\right]. \tag{E14}$$

At the resonance frequency $\omega_0$, $$\omega_0 CW = ctg\gamma_0 L. \tag{E15}$$

By inputting the resonant size shorting factor, and taking into account that without the capacitor the resonant size is $$\frac{\lambda}{4},$$

the following relationship holds:

$$ctg\gamma_0 L = ctg\left(\frac{2\pi}{\lambda_0}\frac{\lambda_0}{4}\frac{1}{\beta}\right) = ctg\left(\frac{\pi}{2\beta}\right), \tag{E16}$$

where $\lambda_0$ is the resonance wavelength. The resonant size shorting factor is the ratio of the resonant size of the radiating element in which there are shorting elements (dielectric or end capacitor) to the resonant size of the radiating element in which there are no shorting elements. The resonant size shorting factor is equal to the equivalent wave-slowing factor β. The resonance condition may then be re-written in the form:

$$\frac{W}{X_{C0}} = ctg\left(\frac{\pi}{2\beta}\right), \tag{E17}$$

where $X_{C0}$ is the capacitive reactance at the resonance frequency. Furthermore, $$\frac{dB}{d\omega}_{\omega=\omega_0} = \frac{d}{d\omega}\left(\omega C - \frac{1}{W} ctg\gamma L\right)_{\omega=\omega_0} = C - \left(\frac{1}{W}\frac{-1}{\sin^2\gamma L} L \frac{d\gamma}{d\omega}\right)_{\omega=\omega_0} = C + \left(\frac{1}{W}\frac{1}{\sin^2\gamma L} L \frac{1}{c}\beta\right)_{\omega=\omega_0} = \frac{1}{W\omega_0}\left(ctg\left(\frac{\pi}{2\beta}\right) + \frac{1}{\sin^2\left(\frac{\pi}{2\beta}\right)}\left(\frac{\pi}{2\beta}\right)\right), \tag{E18}$$

and the Q-factor is:

$$Q = \frac{R}{2}\omega_0 \frac{1}{W\omega_0}\left(ctg\left(\frac{\pi}{2\beta}\right) + \frac{1}{\sin^2\left(\frac{\pi}{2\beta}\right)}\left(\frac{\pi}{2\beta}\right)\right) = \frac{R}{2}\frac{1}{W}\left(ctg\left(\frac{\pi}{2\beta}\right) + \frac{1}{\sin^2\left(\frac{\pi}{2\beta}\right)}\left(\frac{\pi}{2\beta}\right)\right). \tag{E19}$$

For a square-shaped radiating element, following the calculations similar to (E9)-(E13), Q is given by:

$$Q = \frac{1}{4}\frac{\lambda}{h}\left[\frac{2}{\pi} ctg\left(\frac{\pi}{2\beta}\right) + \frac{1}{\sin^2\left(\frac{\pi}{2\beta}\right)}\frac{1}{\beta}\right]. \tag{E20}$$

Figure 5:
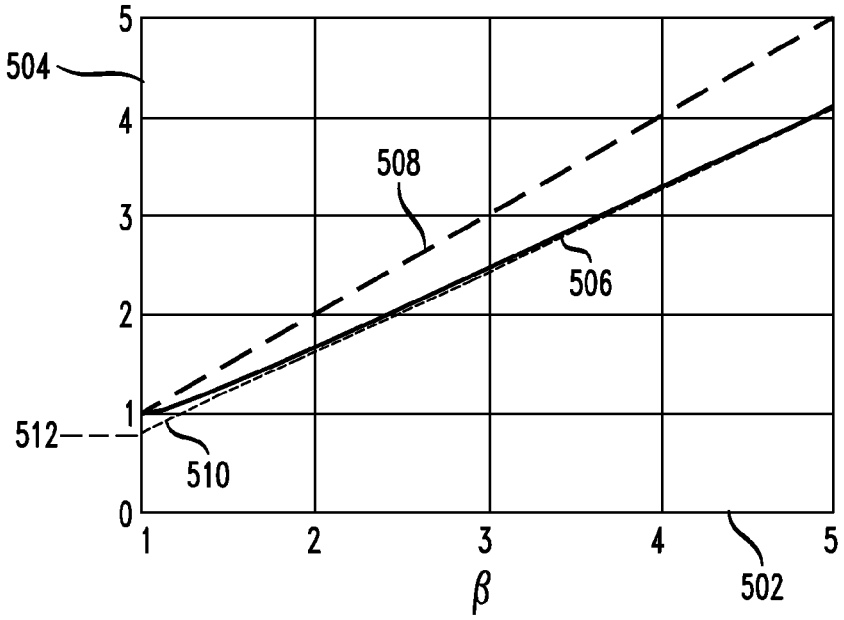
FIG. 5 shows a graph of Q-factor as a function of equivalent wave-slowing.

A graph of the function Q'=4(h/λ)Q versus the wave-slowing factor β is shown in FIG. 5. The values of β are plotted along the horizontal axis 502. The corresponding values of Q' are plotted along the vertical axis 504. The solid line 506 is the plot of Q' versus β according to (E20). The dashed line 508 plots Q' versus β for a solid dielectric medium (such as a dielectric substrate). Note that at sufficiently large values of β, the following approximation holds:

$$Q = \frac{1}{4}\frac{\lambda}{h}\left[\frac{2}{\pi}\frac{1}{\frac{\pi}{2\beta}} + \frac{1}{\left(\frac{\pi}{2\beta}\right)^2}\frac{1}{\beta}\right] \approx \frac{1}{4}\frac{\lambda}{h}\frac{8}{\pi^2}\beta. \tag{E21}$$

The dotted line 510 plots Q' versus β, according to the asymptotic relationship (E21). Therefore, at a value of β≈1.5, the Q-factor is approximately 0.8 of that for the previously considered cases of a dielectric substrate or air gap (E13). Hence, the shortening of the resonant size by using an end capacitor results in a 20% increase in bandwidth compared with a dielectric substrate.

Referring back to FIG. 1, in embodiments of the invention, the radiating patch (element) 102 and the ground plane 104 may have various geometrical shapes, including square, rectangular, circular, and elliptical. One skilled in the art may configure different geometrical shapes for different applications. In some embodiments, the ground plane has the same size and geometrical shape as the radiating element. For example, the radiating element and the ground plane may both be rectangles of the same size. In other embodiments, the ground plane is larger than the radiating element, and the geometrical shape of the ground plane may be arbitrary with respect to the geometrical shape of the radiating element. For example, the radiating element may be a circle, and the ground plane may be a square, in which the length of the side of the square is greater than the diameter of the circle. Specific geometries are discussed in more detail below.

Figure 6A:
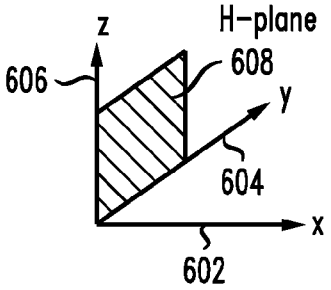
FIG. 6A and FIG. 6B show a reference Cartesian coordinate system for E and H vectors.
Figure 6B:
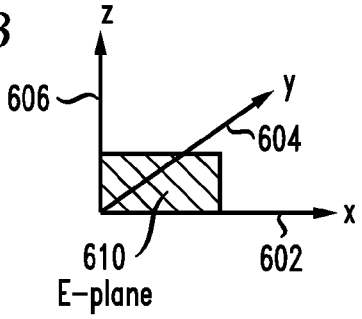
Figure 7:
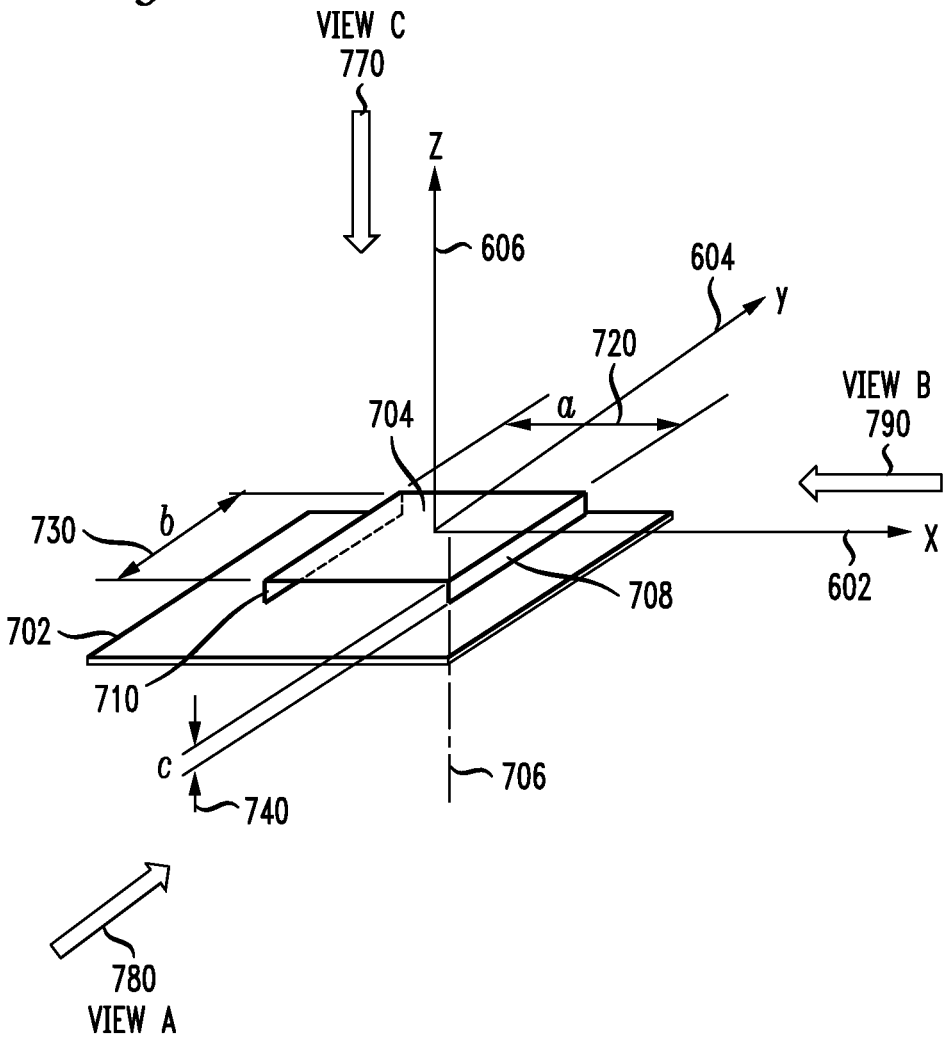
FIG. 7 shows a schematic of a linearly-polarized antenna with capacitive elements comprising extended continuous structures along two edges of a rectangular radiating element.
Figure 16:
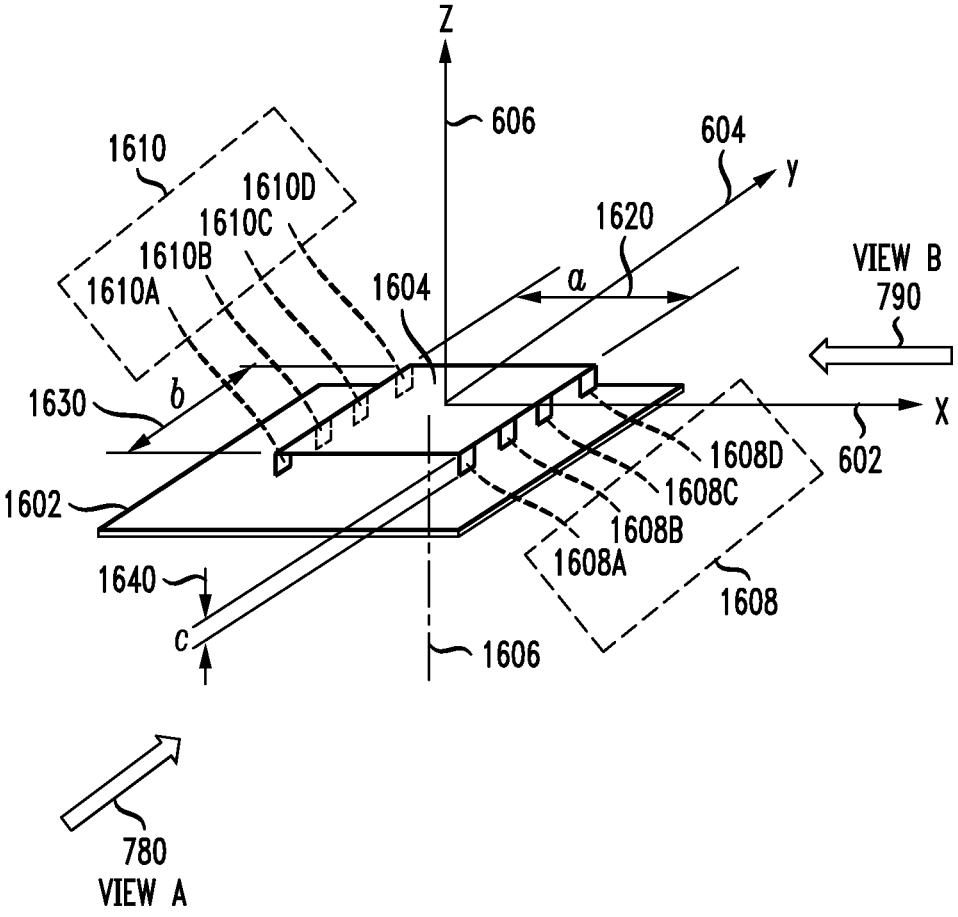
FIG. 16 shows a schematic of a linearly-polarized antenna with capacitive elements comprising a series of localized structures along two edges of a rectangular radiating element.

FIG. 6A and FIG. 6B show a reference Cartesian coordinate system, defined by x-axis 602, y-axis 604, and z-axis 606. In the example shown in FIG. 6A, the magnetic field H-plane 608 lies in the y-z plane. As shown in FIG. 6B, the electric field E-plane 610 lies in the x-z plane. For a linearly-polarized antenna, the capacitive elements may be configured as conductive extended continuous structures (ECSs), as shown in FIG. 7, oriented along the strip side parallel to H-plane 608; or as a conductive series of localized structures (SLSs), as shown in FIG. 16, oriented along the strip side parallel to H-plane 608. The geometry of the structures determine the equivalent capacitance. The resonance size decreases as the overlap of the structures on the radiating element and the structures on the ground plane increases. Consequently, a design with extended continuous structures, as shown in FIG. 7, may provide the smallest resonant size. A design with a series of localized structures, as shown in FIG. 16, may allow more precise tuning of the antenna.

The embodiment shown in FIG. 7 illustrates a linearly-polarized antenna design, which includes ground plane 702 and radiating element 704. The ground plane 702 and the radiating element 704 are separated by an air gap. Radiating element 704 is fed by a rod exciter 706, such as the center conductor of a coaxial cable. Supports which hold the radiating element 704 over the ground plane 702 are not shown. These supports, for example, may be thin isolation standoffs which do not introduce significant changes in antenna electrical parameters. In the embodiment shown in FIG. 7, the radiating element 704 has a rectangular geometry, with length b 730 along y-axis 604 and a width a 720 along x-axis 602. Note that the rectangular geometry includes the case of a square geometry (length b 730 equal to width a 720). As discussed above, the ground plane 702 may be larger than the radiating element 704.

The capacitive elements are oriented parallel to the H-plane 608 (FIG. 6A) and parallel to the y-axis 604. There are no capacitive elements parallel to the E-plane 608 (FIG. 6B). In FIG. 7, the capacitive elements comprise conductive extended continuous structure (ECS) 708 and extended continuous structure 710. ECS 708 and ECS 710 are located along the two edges of the radiating element 704 parallel to the y-axis 604. ECS 708 and ECS 710 have rectangular cross-sections with length b 730 and height c 740. The height c 740 is measured along the z-axis 606. In the example shown in FIG. 7, the plane of ECS 708 and the plane of ECS 710 are orthogonal to the plane of radiating element 704. In general, they do not need to be orthogonal. One skilled in the art may vary the orientation angles (between the plane of ECS 708 and the plane of radiating element 704 and between the plane of ECS 710 and the plane of radiating element 704) to tune the antenna. In general, the cross-sections of ECS 708 and ECS 710 do not need to be rectangular. For example, they may be cylindrical. One skilled in the art may implement different cross-sections for different applications.

FIG. 8-FIG. 15 illustrate embodiments with different combinations, shapes, and locations of ECSs. In FIG. 8-FIG. 15, two views are shown. Referring to FIG. 7, View A 780 is the view along the (+) direction of y-axis 604. View B 790 is the view along the (−) direction of x-axis 602. Both the radiating element and the ground plane have rectangular geometries.

Figure 45A:
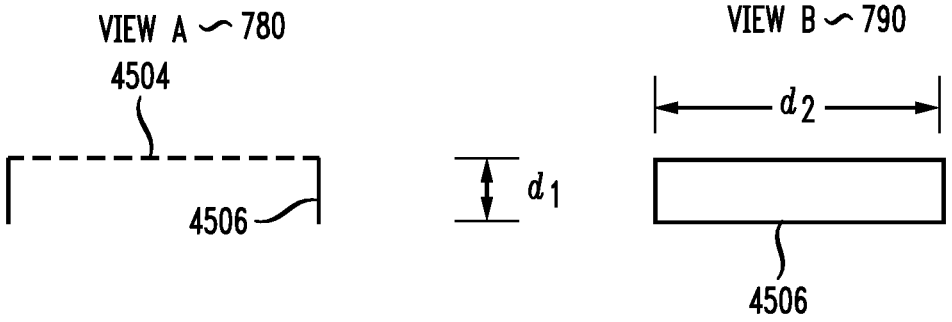
FIG. 45A-FIG. 45C show schematics of straight, inwardly-bent, and outwardly-bent extended continuous structures.
Figure 45B:
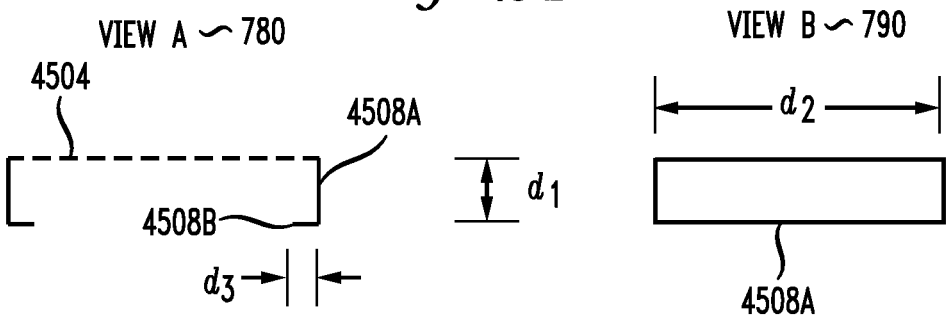
Figure 45C:
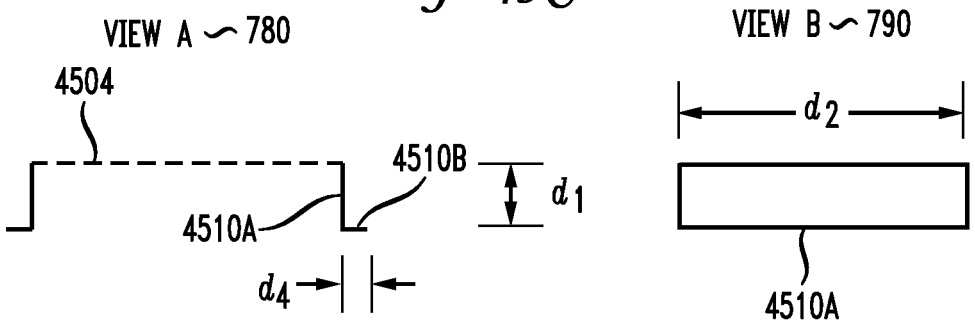

As shown in FIG. 45A-FIG. 45C, the cross-section of an ECS may be straight, inwardly-bent, or outwardly-bent. FIG. 45A shows a straight ECS 4506 along the edge of radiating element 4504. ECS 4506 has a length $d_1$ measured along the z-axis 606 and a length $d_2$ measured along the y-axis 604. FIG. 45B shows an inwardly-bent ECS, comprising section ECS 4508A and section ECS 4508B, along the edge of radiating element 4504. ECS 4508A has a length $d_1$ measured along the z-axis 606 and a length $d_2$ measured along the y-axis 604. ECS 4508B has a length $d_3$ measured along the x-axis 602 and a length $d_2$ measured along the y-axis 604. FIG. 45C shows an outwardly-bent ECS, comprising section ECS 4510A and section ECS 4510B, along the edge of radiating element 4504. ECS 4510A has a length $d_1$ measured along the z-axis 606 and a length $d_2$ measured along the y-axis 604. ECS 4510B has a length $d_4$ measured along the x-axis 602 and a length $d_2$ measured along the y-axis 604. In the examples shown in FIG. 45A-FIG. 45C, the bend angles (for example, the angle between ECS 4508A and ECS 4508B, or the angle between ECS 4510A and ECS 4510B) are 90 degrees. In general, the bend angles may be varied to suit specific applications.

Figure 8:
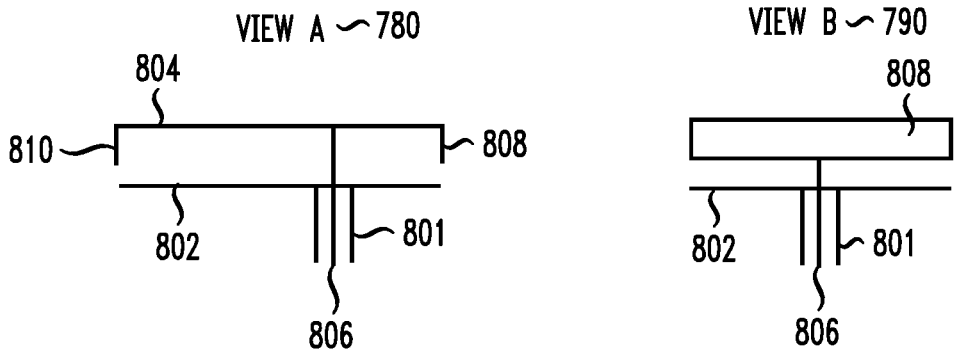
FIG. 8-FIG. 15 show schematics of a linearly-polarized antenna with various configurations of capacitive elements comprising extended continuous structures.

In FIG. 8, the antenna includes ground plane 802 and radiating element 804, which is fed by a coaxial cable with center conductor 806 and outer conductor 801. ECS 808 and ECS 810 are oriented parallel to the H-plane 608 and are located along the two edges of the radiating element 804 parallel to the y-axis 604. ECS 808 and ECS 810 are both straight ECSs.

Figure 9:
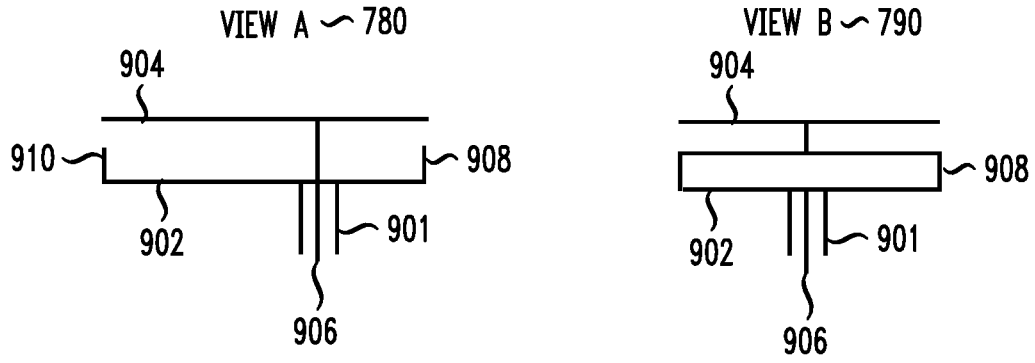

In FIG. 9, the antenna includes ground plane 902 and radiating element 904, which is fed by a coaxial cable with center conductor 906 and outer conductor 901. ECS 908 and ECS 910 are oriented parallel to the H-plane 608 and are located along the two edges of the ground plane 902 parallel to the y-axis 604. ECS 908 and ECS 910 are both straight ECSs.

Figure 10:
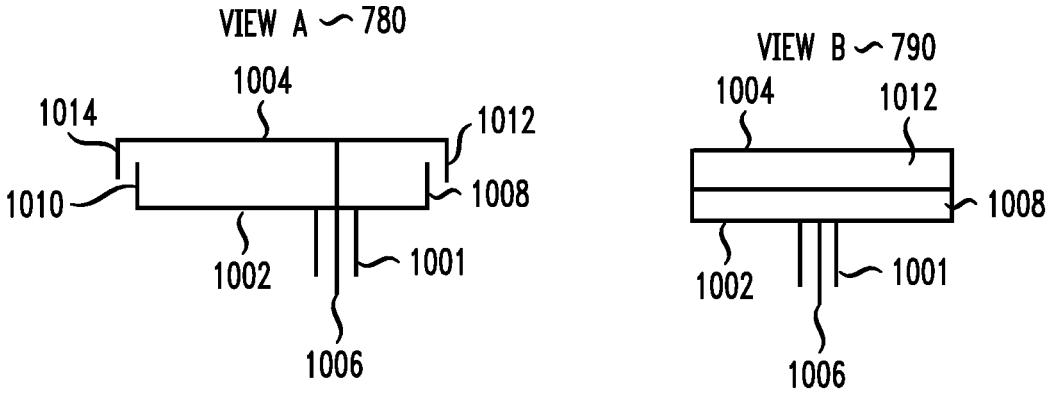

In FIG. 10, the antenna includes ground plane 1002 and radiating element 1004, which is fed by a coaxial cable with center conductor 1006 and outer conductor 1001. ECS 1012 and ECS 1014 are oriented parallel to the H-plane 608 and are located along the two edges of the radiating element 1004 parallel to the y-axis 604. ECS 1008 and ECS 1010 are oriented parallel to the H-plane 608 and are located along the two edges of the ground plane 1002 parallel to the y-axis 604. ECS 1008 and ECS 1010 are located partially within the region between ECS 1012 and ECS 1014. ECS 1008, ECS 1010, ECS 1012, and ECS 1014 are all straight ECSs.

Figure 11:
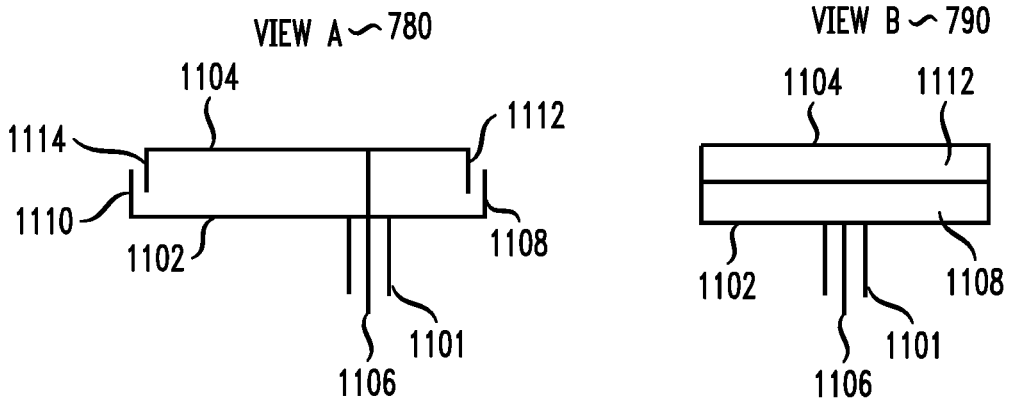

In FIG. 11, the antenna includes ground plane 1102 and radiating element 1104, which is fed by a coaxial cable with center conductor 1106 and outer conductor 1101. ECS 1112 and ECS 1114 are oriented parallel to the H-plane 608 and are located along the two edges of the radiating element 1104 parallel to the y-axis 604. ECS 1108 and ECS 1110 are oriented parallel to the H-plane 608 and are located along the two edges of the ground plane 1102 parallel to the y-axis 604. ECS 1112 and ECS 1114 are located partially within the region between ECS 1108 and ECS 1110. ECS 1112, ECS 1114, ECS 1108, and ECS 1110 are all straight ECSs.

Figure 12:
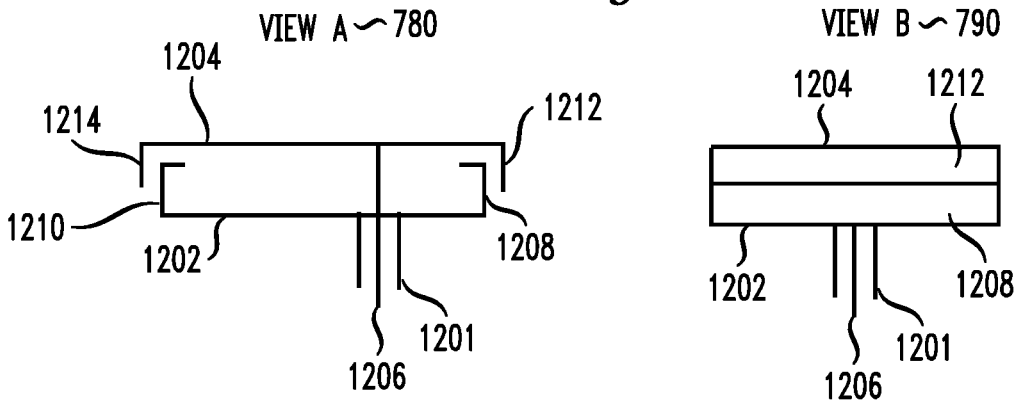

In FIG. 12, the antenna includes ground plane 1202 and radiating element 1204, which is fed by a coaxial cable with center conductor 1206 and outer conductor 1201. ECS 1212 and ECS 1214 are oriented parallel to the H-plane 608 and are located along the two edges of the radiating element 1204 parallel to the y-axis 604. ECS 1208 and ECS 1210 are oriented parallel to the H-plane 608 and are located along the two edges of the ground plane 1202 parallel to the y-axis 604. ECS 1208 and ECS 1210 are located partially within the region between ECS 1212 and ECS 1214. ECS 1208 and ECS 1210 are both inwardly-bent ECSs. ECS 1212 and ECS 1214 are both straight ECSs.

Figure 13:
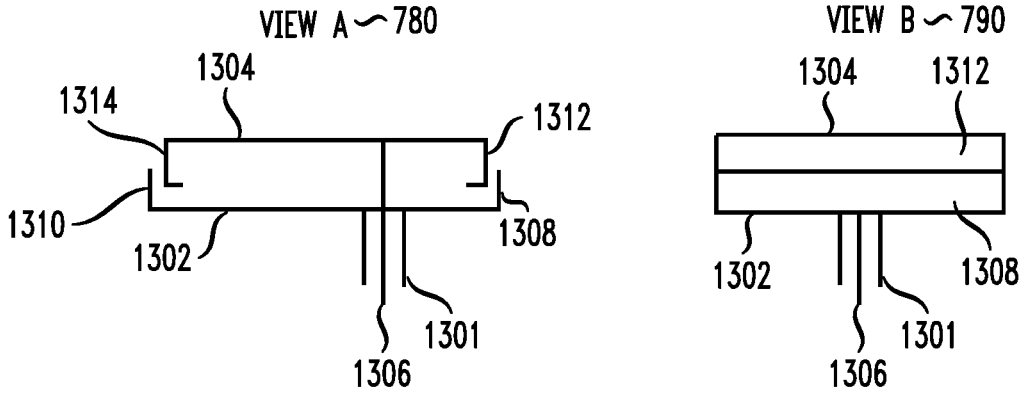

In FIG. 13, the antenna includes ground plane 1302 and radiating element 1304, which is fed by a coaxial cable with center conductor 1306 and outer conductor 1301. ECS 1312 and ECS 1314 are oriented parallel to the H-plane 608 and are located along the two edges of the radiating element 1304 parallel to the y-axis 604. ECS 1308 and ECS 1310 are oriented parallel to the H-plane 608 and are located along the two edges of the ground plane 1302 parallel to the y-axis 604. ECS 1312 and ECS 1314 are located partially within the region between ECS 1308 and ECS 1310. ECS 1308 and ECS 1310 are both straight ECSs. ECS 1312 and ECS 1314 are both inwardly-bent ECSs.

Figure 14:
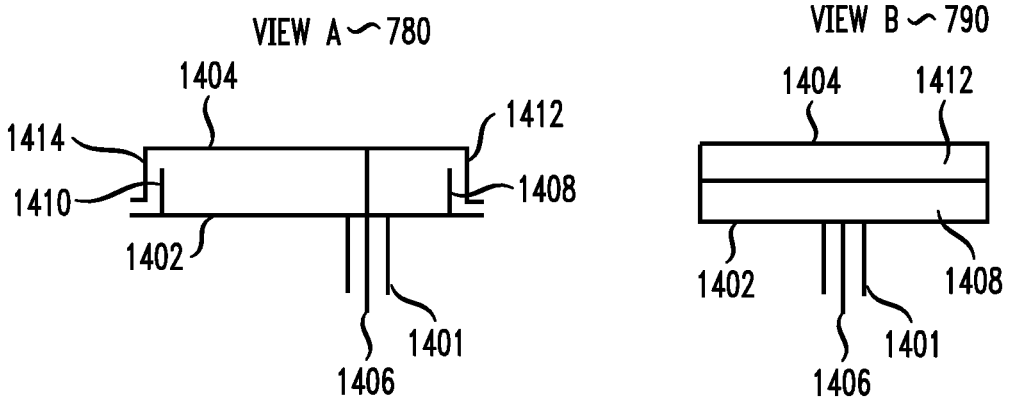

In FIG. 14, the antenna includes ground plane 1402 and radiating element 1404, which is fed by a coaxial cable with center conductor 1406 and outer conductor 1401. ECS 1412 and ECS 1414 are oriented parallel to the H-plane 608 and are located along the two edges of the radiating element 1404 parallel to the y-axis 604. ECS 1408 and ECS 1410 are oriented parallel to the H-plane 608 and are located along the two edges of the ground plane 1402 parallel to the y-axis 604. ECS 1408 and ECS 1410 are located partially within the region between ECS 1412 and ECS 1414. ECS 1408 and ECS 1410 are both straight ECSs. ECS 1412 and ECS 1414 are both outwardly-bent ECSs.

Figure 15:
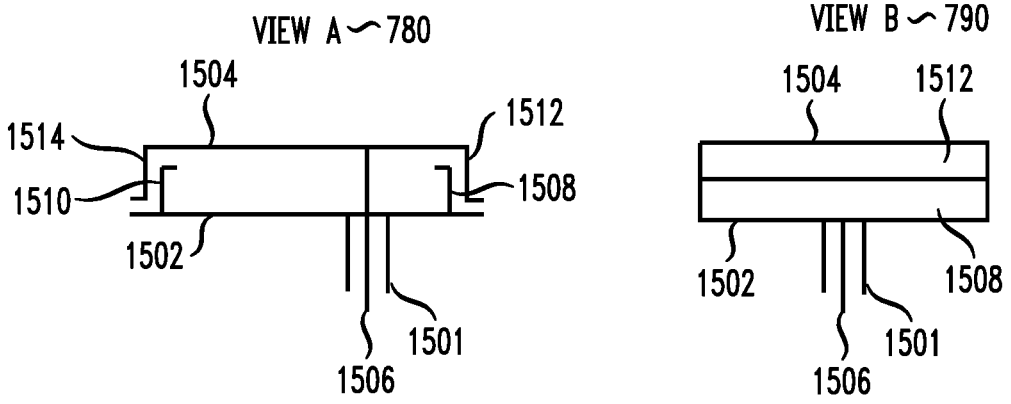

In FIG. 15, the antenna includes ground plane 1502 and radiating element 1504, which is fed by a coaxial cable with center conductor 1506 and outer conductor 1501. ECS 1512 and ECS 1514 are oriented parallel to the H-plane 608 and are located along the two edges of the radiating element 1504 parallel to the y-axis 604. ECS 1508 and ECS 1510 are oriented parallel to the H-plane 608 and are located along the two edges of the ground plane 1502 parallel to the y-axis 604. ECS 1508 and ECS 1510 are located partially within the region between ECS 1512 and ECS 1514. ECS 1508 and ECS 1510 are both inwardly-bent ECSs. ECS 1512 and ECS 1514 are both outwardly-bent ECSs.

The embodiment shown in FIG. 16 illustrates a linearly-polarized antenna design, which includes ground plane 1602 and radiating element 1604. The ground plane 1602 and the radiating element 1604 are separated by an air gap. Radiating element 1604 is fed by a rod exciter 1606, such as the center conductor of a coaxial cable. Supports which hold the radiating element 1604 over the ground plane 1602 are not shown. These supports, for example, may be thin isolation standoffs which do not introduce significant changes in antenna electrical parameters. In the embodiment shown in FIG. 16, the radiating element 1604 has a rectangular geometry, with length b 1630 along y-axis 604 and a width a 1620 along x-axis 602. Note that the rectangular geometry includes the case of a square geometry (length b 1630 equal to width a 1620). The ground plane 1602 may be larger than the radiating element 1604.

The capacitive elements are oriented parallel to the H-plane 608 (FIG. 6A) and parallel to the y-axis 604. There are no capacitive elements located parallel to the E-plane 608 (FIG. 6B). In FIG. 16, the capacitive elements comprise a conductive series of localized structures (SLS) 1608 and series of localized structures 1610. SLS 1608 comprises localized structure (LS) 1608A-localized structure 1608D. SLS 1610 comprises LS 1610A-LS 1610D. The number of localized structures in a series of localized structures are user-defined. SLS 1608 and SLS 1610 are located along the two edges of radiating element 1604 parallel to the y-axis 604. In the embodiment shown in FIG. 16, the localized structures have height c 1640. The height c 1640 is measured along the z-axis 606. In the example shown in FIG. 16, the plane of SLS 1608 and the plane of SLS 1610 are orthogonal to the plane of radiating element 1604. In general, they do not need to be orthogonal. One skilled in the art may vary the orientation angles (between the plane of SLS 1608 and the plane of radiating element 1604 and between the plane of SLS 1610 and the plane of radiating element 1604) to tune the antenna. In general, the cross-section of an individual localized structure does not need to be rectangular. For example, it may be cylindrical. One skilled in the art may implement different cross-sections for different applications.

Figure 17:
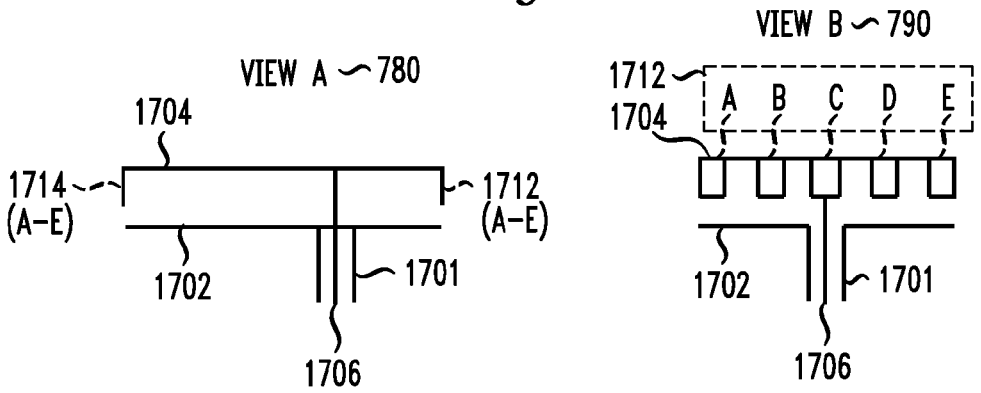
FIG. 17-FIG. 27 show schematics of a linearly-polarized antenna with various configurations of capacitive elements comprising series of localized structures.
Figure 46:
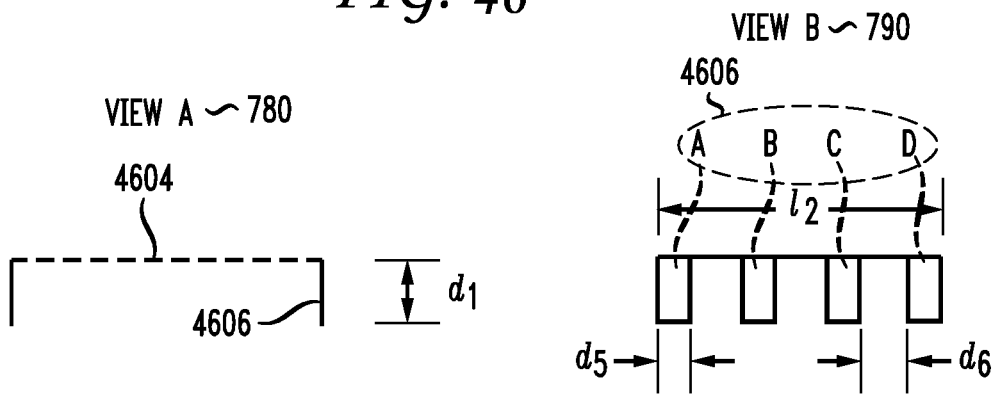
FIG. 46 shows a schematic of a straight series of localized structures.

FIG. 17-FIG. 27 illustrate embodiments with different combinations, shapes, and locations of SLSs. In FIG. 8-FIG. 15, two views are shown. Referring to FIG. 16, View A 780 is the view along the (+) direction of y-axis 604. View B 790 is the view along the (−) direction of x-axis 602. Similar to the ECS cross-sections shown in FIG. 45A-FIG. 45C, the cross-section of a localized structure may be straight, inwardly-bent, or outwardly-bent. The bend angles may be varied. FIG. 46 shows a close-up view of a straight SLS 4606 along the edge of radiating element 4604. SLS 4606 comprises LS 4606A-LS 4606D. Each LS has a length $d_1$ measured along the z-axis 606. The width of each LS is $d_5$, and the spacing between two adjacent LSs is $d_6$. The values $d_5$ and $d_6$ are measured along the y-axis 604. In FIG. 17, the antenna includes ground plane 1702 and radiating element 1704, which is fed by a coaxial cable with center conductor 1706 and outer conductor 1701. SLS 1712 (comprising LS 1712A-LS 1712E) and SLS 1714 (comprising LS 1714A-LS 1714E, not shown) are oriented parallel to the H-plane 608 and are located along the two edges of the radiating element 1704 parallel to the y-axis 604. SLS 1712 and SLS 1714 are both straight SLSs.

Figure 18:
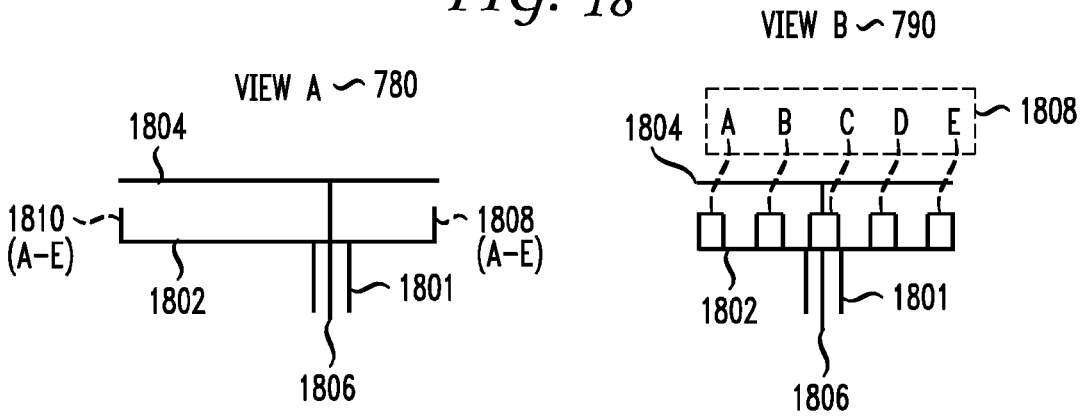

In FIG. 18, the antenna includes ground plane 1802 and radiating element 1804, which is fed by a coaxial cable with center conductor 1806 and outer conductor 1801. SLS 1808 (comprising LS 1808A-LS 1808E) and SLS 1810 (comprising LS 1810A-LS 1810E, not shown) are oriented parallel to the H-plane 608 and are located along the two edges of the ground plane 1802 parallel to the y-axis 604. SLS 1808 and SLS 1810 are both straight SLSs.

Figure 19:
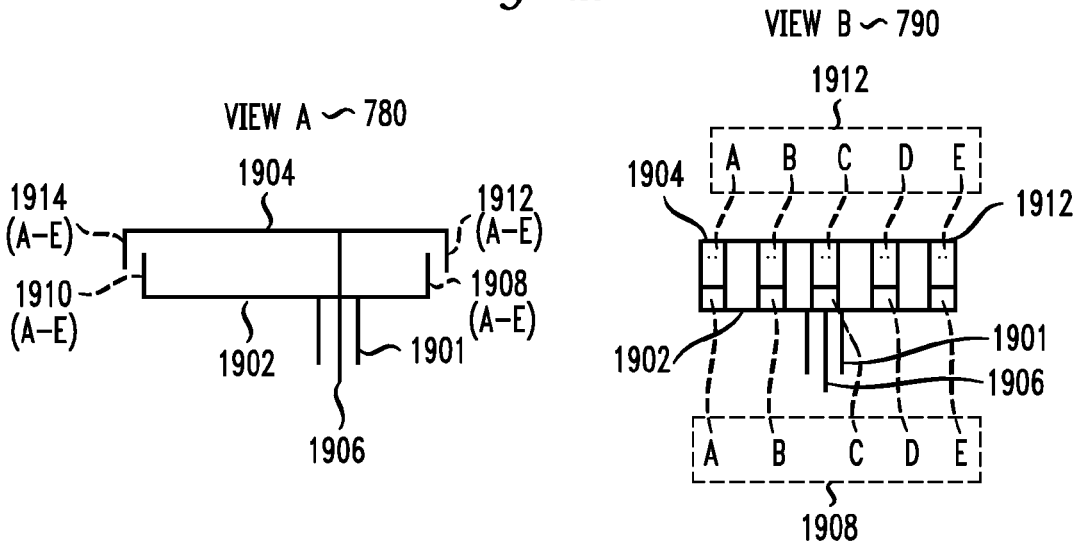

In FIG. 19, the antenna includes ground plane 1902 and radiating element 1904, which is fed by a coaxial cable with center conductor 1906 and outer conductor 1901. SLS 1912 (comprising LS 1912A-LS 1912E) and SLS 1914 (comprising LS 1914A-LS 1914E, not shown) are oriented parallel to the H-plane 608 and are located along the two edges of the radiating element 1904 parallel to the y-axis 604. SLS 1908 (comprising LS 1908A-LS 1908E) and SLS 1910 (comprising LS 1910A-LS 1910E, not shown) are oriented parallel to the H-plane 608 and are located along the two edges of the ground plane 1902 parallel to the y-axis 604. SLS 1908 and SLS 1910 are located partially within the region between SLS 1912 and SLS 1914. SLS 1908, SLS 1910, SLS 1912, and SLS 1914 are all straight SLSs. Along the y-axis 604, SLS 1908 is aligned with SLS 1912, and SLS 1910 is aligned with SLS 1914.

Figure 20:
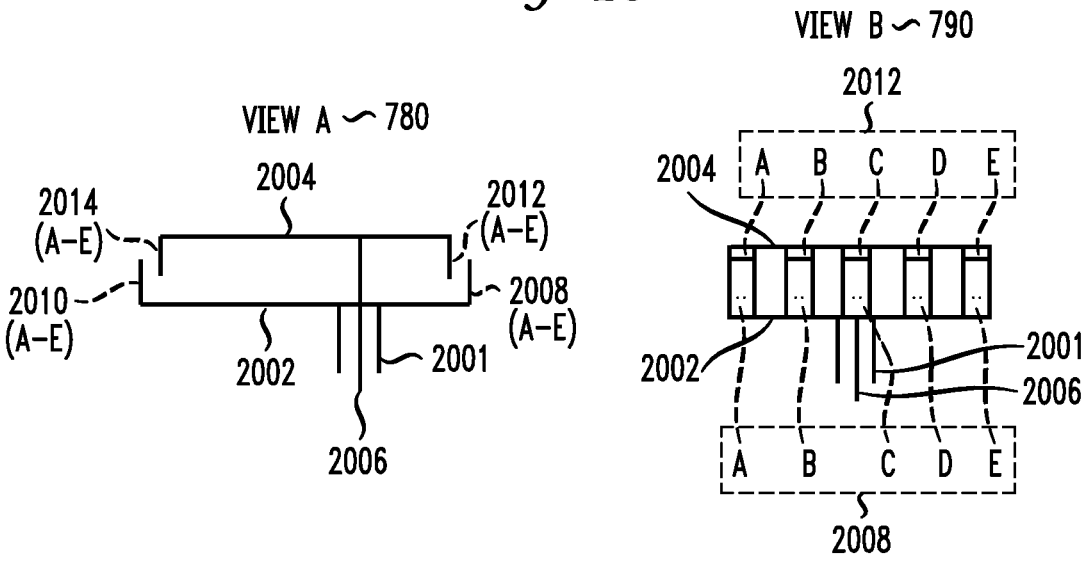

In FIG. 20, the antenna includes ground plane 2002 and radiating element 2004, which is fed by a coaxial cable with center conductor 2006 and outer conductor 2001. SLS 2012 (comprising LS 2012A-LS 2012E) and SLS 2014 (comprising LS 2014A-LS 2014E, not shown) are oriented parallel to the H-plane 608 and are located along the two edges of the radiating element 2004 parallel to the y-axis 604. SLS 2008 (comprising LS 2008A-LS 2008E) and SLS 2010 (comprising LS 2010A-LS 2010E, not shown) are oriented parallel to the H-plane 608 and are located along the two edges of the ground plane 2002 parallel to the y-axis 604. SLS 2012 and SLS 2014 are located partially within the region between SLS 2008 and SLS 2010. SLS 2008, SLS 2010, SLS 2012, and SLS 2014 are all straight SLSs. Along the y-axis 604, SLS 2008 is aligned with SLS 2012, and SLS 2010 is aligned with SLS 2014.

Figure 21:
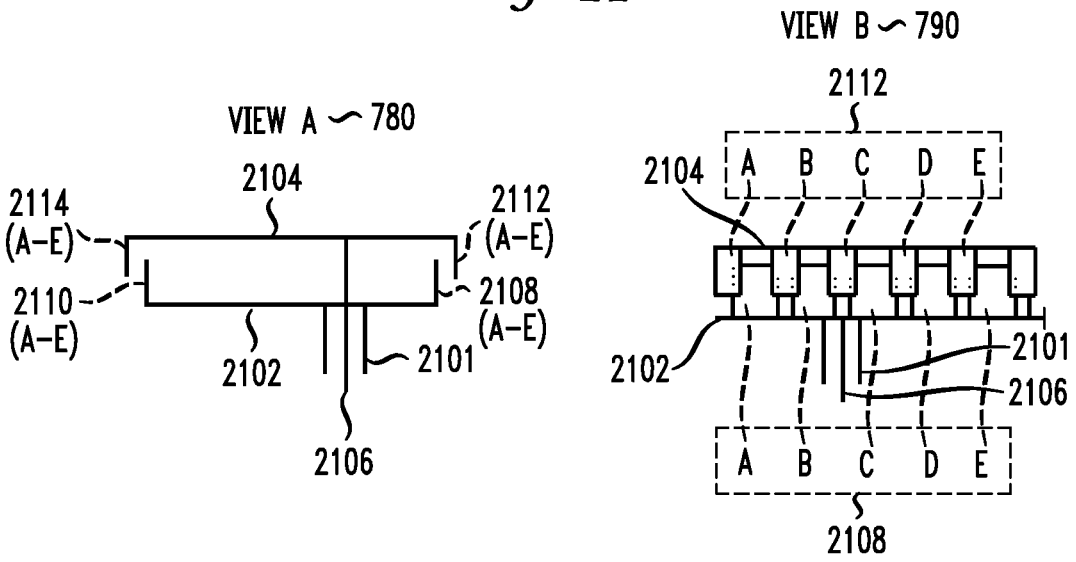

In FIG. 21, the antenna includes ground plane 2102 and radiating element 2104, which is fed by a coaxial cable with center conductor 2106 and outer conductor 2101. SLS 2112 (comprising LS 2112A-LS 2112E) and SLS 2114 (comprising LS 2114A-LS 2114E, not shown) are oriented parallel to the H-plane 608 and are located along the two edges of the radiating element 2104 parallel to the y-axis 604. SLS 2108 (comprising LS 2108A-LS 2108E) and SLS 2110 (comprising LS 2110A-LS 2110E, not shown) are oriented parallel to the H-plane 608 and are located along the two edges of the ground plane 2102 parallel to the y-axis 604. SLS 2108 and SLS 2110 are located partially within the region between SLS 2112 and SLS 2114. SLS 2108, SLS 2110, SLS 2112, and SLS 2114 are all straight SLSs. Along the y-axis 604, SLS 2108 is displaced from SLS 2112, and SLS 2110 is displaced from SLS 2114.

Figure 22:
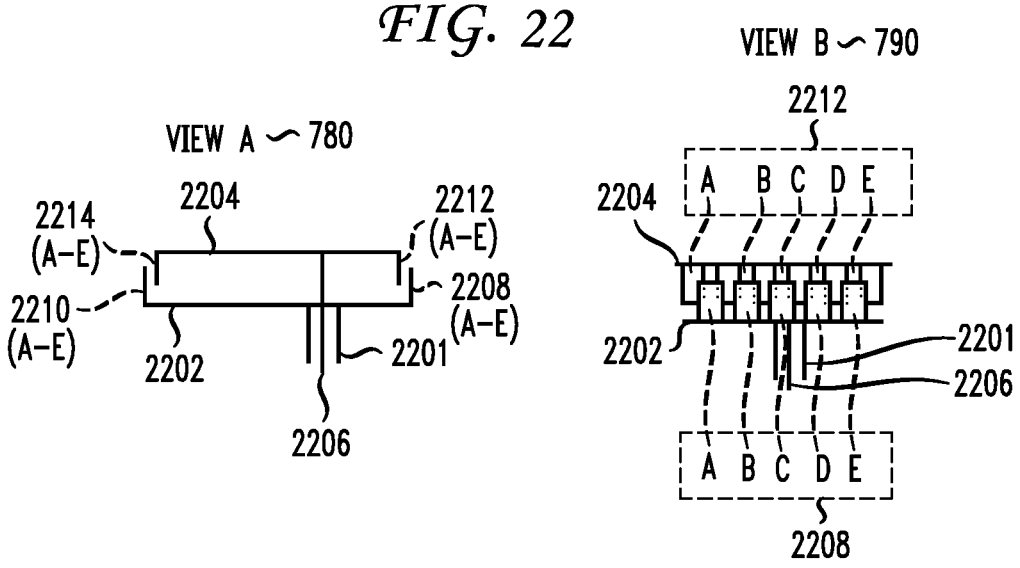

In FIG. 22, the antenna includes ground plane 2202 and radiating element 2204, which is fed by a coaxial cable with center conductor 2206 and outer conductor 2201. SLS 2212 (comprising LS 2212A-LS 2212E) and SLS 2214 (comprising LS 2214A-LS 2214E, not shown) are oriented parallel to the H-plane 608 and are located along the two edges of the radiating element 2204 parallel to the y-axis 604. SLS 2208 (comprising LS 2208A-LS 2208E) and SLS 2210 (comprising LS 2210A-LS 2210E, not shown) are oriented parallel to the H-plane 608 and are located along the two edges of the ground plane 2202 parallel to the y-axis 604. SLS 2212 and SLS 2214 are located partially within the region between SLS 2208 and SLS 2210. SLS 2208, SLS 2210, SLS 2212, and SLS 2214 are all straight SLSs. Along the y-axis 604, SLS 2208 is displaced from SLS 2212, and SLS 2210 is displaced from SLS 2214.

Figure 23:
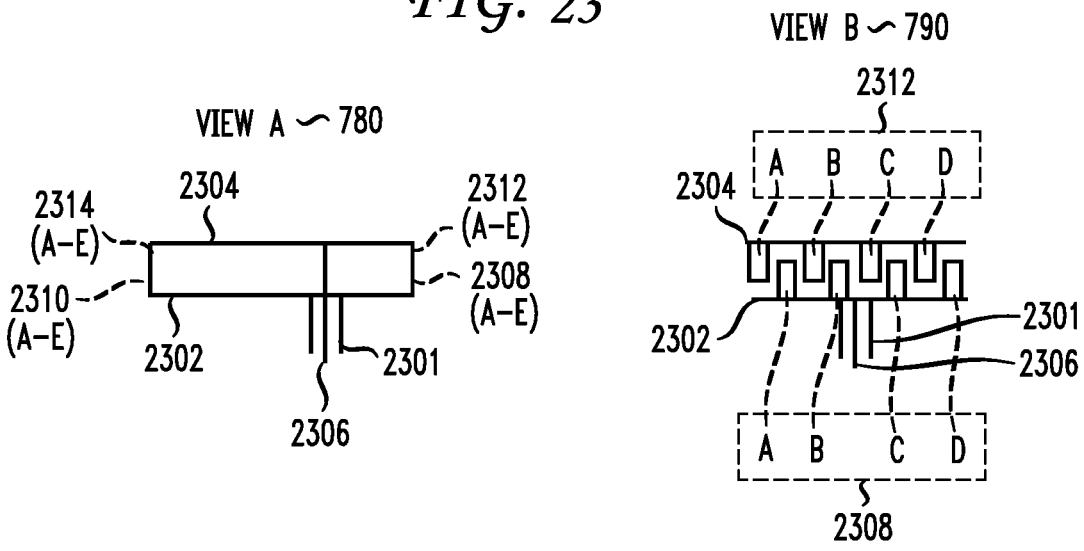

In FIG. 23, the antenna includes ground plane 2302 and radiating element 2304, which is fed by a coaxial cable with center conductor 2306 and outer conductor 2301. SLS 2312 (comprising LS 2312A-LS 2312E) and SLS 2314 (comprising LS 2314A-LS 2314E, not shown) are oriented parallel to the H-plane 608 and are located along the two edges of the radiating element 2004 parallel to the y-axis 604. SLS 2308 (comprising LS 2308A-LS 2308E) and SLS 2310 (comprising LS 2310A-LS 2310E, not shown) are oriented parallel to the H-plane 608 and are located along the two edges of the ground plane 2302 parallel to the y-axis 604. SLS 2308, SLS 2310, SLS 2312, and SLS 2314 are all straight SLSs. Along the x-axis 602, SLS 2308 is aligned with SLS 2312, and SLS 2310 is aligned with SLS 2314. Along the y-axis 604 and along the z-axis 606, SLS 2308 and SLS 2312 are interdigitated, and SLS 2310 and SLS 2314 are interdigitated, as shown in FIG. 23, View B 790.

Figure 24:
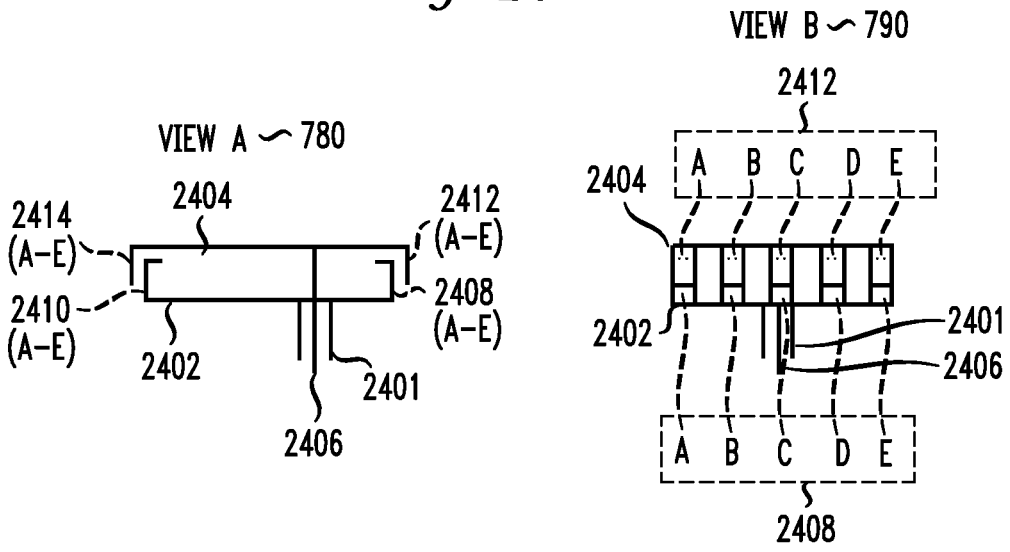

In FIG. 24, the antenna includes ground plane 2402 and radiating element 2404, which is fed by a coaxial cable with center conductor 2406 and outer conductor 2401. SLS 2412 (comprising LS 2412A-LS 2412E) and SLS 2414 (comprising LS 2414A-LS 2414E, not shown) are oriented parallel to the H-plane 608 and are located along the two edges of the radiating element 2404 parallel to the y-axis 604. SLS 2408 (comprising LS 2408A-LS 2408E) and SLS 2410 (comprising LS 2410A-LS 2410E, not shown) are oriented parallel to the H-plane 608 and are located along the two edges of the ground plane 2402 parallel to the y-axis 604. SLS 2408 and SLS 2410 are located partially within the region between SLS 2412 and SLS 2414. SLS 2408 and SLS 2410 are both inwardly-bent SLSs. SLS 2412 and SLS 2414 are both straight SLSs. Along the y-axis 604, SLS 2408 is aligned with SLS 2412, and SLS 2410 is aligned with SLS 2414.

Figure 25:
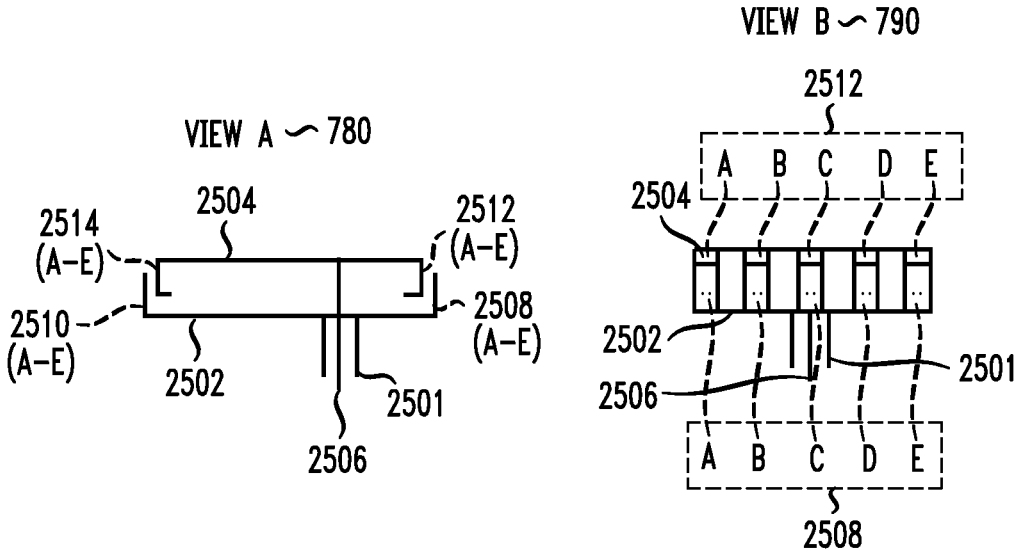

In FIG. 25, the antenna includes ground plane 2502 and radiating element 2504, which is fed by a coaxial cable with center conductor 2506 and outer conductor 2501. SLS 2512 (comprising LS 2512A-LS 2512E) and SLS 2514 (comprising LS 2514A-LS 2514E, not shown) are oriented parallel to the H-plane 608 and are located along the two edges of the radiating element 2504 parallel to the y-axis 604. SLS 2508 (comprising LS 2508A-LS 2508E) and SLS 2510 (comprising LS 2510A-LS 2510E, not shown) are oriented parallel to the H-plane 608 and are located along the two edges of the ground plane 2502 parallel to the y-axis 604. SLS 2512 and SLS 2514 are located partially within the region between SLS 2508 and SLS 2510. SLS 2508 and SLS 2510 are both straight SLSs. SLS 2512 and SLS 2514 are both inwardly-bent SLSs. Along the y-axis 604, SLS 2508 is aligned with SLS 2512, and SLS 2510 is aligned with SLS 2514.

Figure 26:
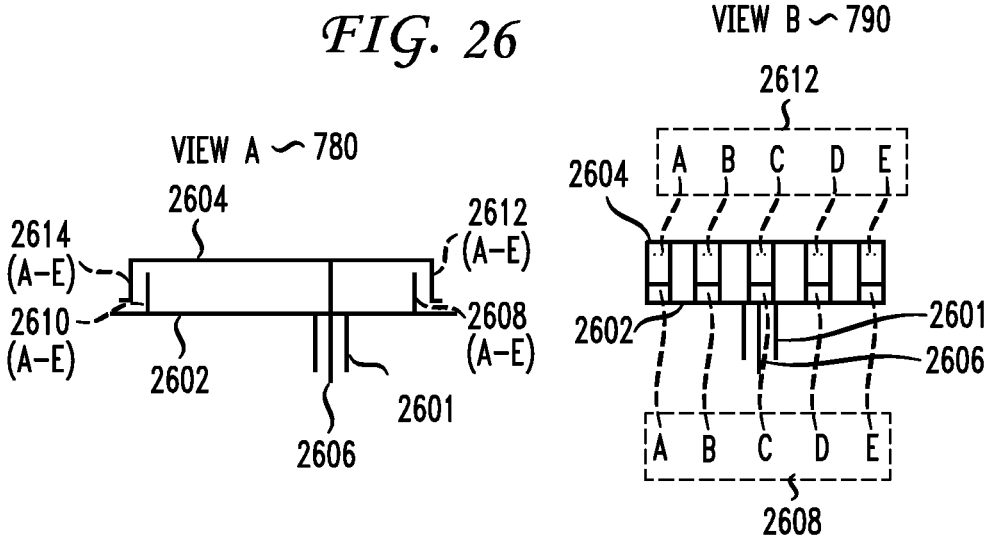

In FIG. 26, the antenna includes ground plane 2602 and radiating element 2604, which is fed by a coaxial cable with center conductor 2606 and outer conductor 2601. SLS 2612 (comprising LS 2612A-LS 2612E) and SLS 2614 (comprising LS 2614A-LS 2614E, not shown) are oriented parallel to the H-plane 608 and are located along the two edges of the radiating element 2604 parallel to the y-axis 604. SLS 2608 (comprising LS 2608A-LS 2608E) and SLS 2610 (comprising LS 2610A-LS 2610E, not shown) are oriented parallel to the H-plane 608 and are located along the two edges of the ground plane 2602 parallel to the y-axis 604. SLS 2608 and SLS 2610 are located partially within the region between SLS 2612 and SLS 2614. SLS 2608 and SLS 2610 are both straight SLSs. SLS 2612 and SLS 2614 are both outwardly-bent SLSs. Along the y-axis 604, SLS 2608 is aligned with SLS 2612, and SLS 2610 is aligned with SLS 2614.

Figure 27:
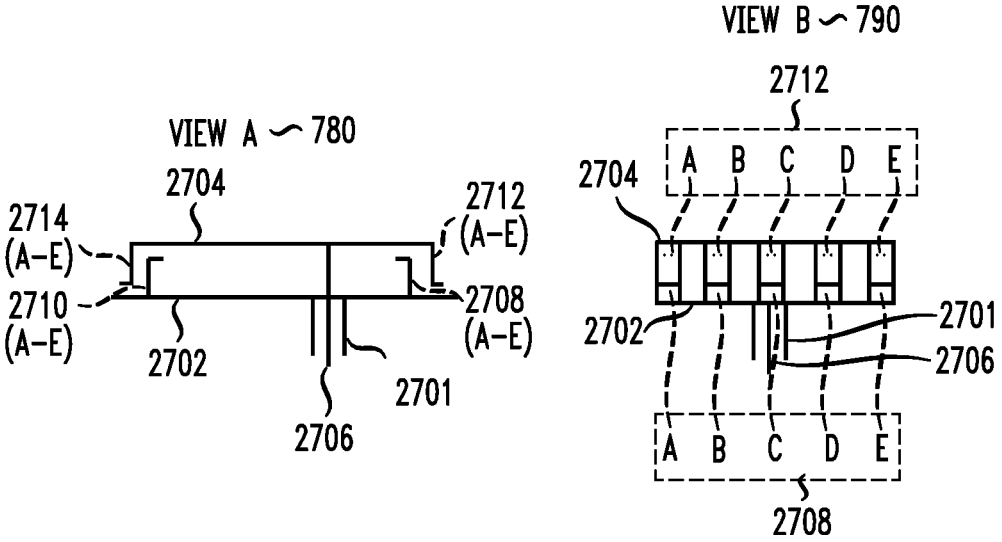

In FIG. 27, the antenna includes ground plane 2702 and radiating element 2704, which is fed by a coaxial cable with center conductor 2706 and outer conductor 2701. SLS 2712 (comprising SLS 2712A-SLS 2712E) and SLS 2714 (comprising LS 2714A-LS 2714E, not shown) are oriented parallel to the H-plane 608 and are located along the two edges of the radiating element 2704 parallel to the y-axis 604. SLS 2708 (comprising LS 2708A-LS 2708E) and SLS 2710 (comprising LS 2710A-LS 2710E, not shown) are oriented parallel to the H-plane 608 and are located along the two edges of the ground plane 2702 parallel to the y-axis 604. SLS 2708 and SLS 2710 are located partially within the region between SLS 2712 and SLS 2714. SLS 2708 and SLS 2710 are both inwardly-bent SLSs. SLS 2712 and SLS 2714 are both outwardly-bent SLSs. Along the y-axis 604, SLS 2708 is aligned with SLS 2712, and SLS 2710 is aligned with SLS 2714.

Figure 31:
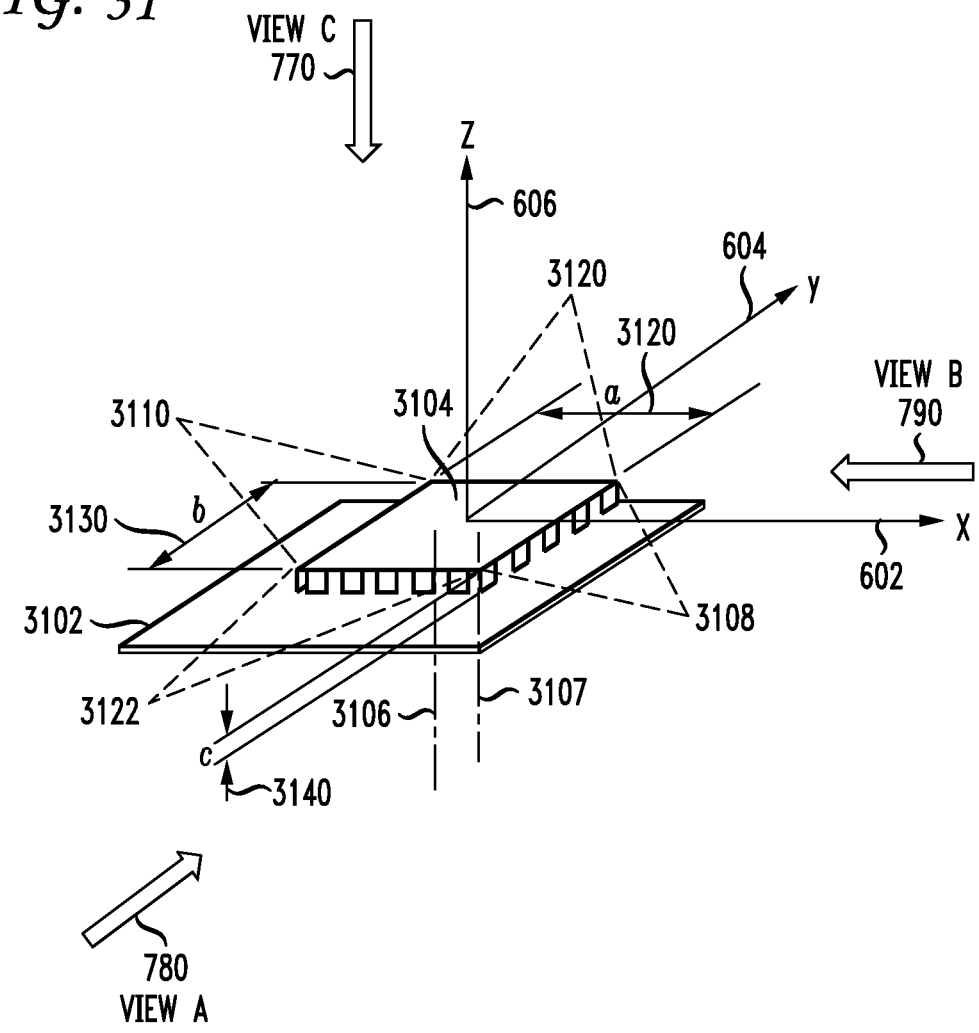
FIG. 31 shows a schematic of a circularly-polarized antenna with capacitive elements comprising series of localized structures along all four edges of a rectangular radiating element.

The embodiment shown in FIG. 31 illustrates a circularly-polarized antenna design, which includes ground plane 3102 and radiating element 3104. The ground plane 3102 and the radiating element 3104 are separated by an air gap. Radiating element 3104 is fed by two rod exciters, rod 3106 and rod 3107. Each rod may be the center conductor of an individual coaxial cable. Supports which hold the radiating element 3104 over the ground plane 3102 are not shown. These supports, for example, may be thin isolation standoffs which do not introduce significant changes in antenna electrical parameters. In the embodiment shown in FIG. 31, the radiating element 3104 has a rectangular geometry, with length b 3130 along y-axis 604 and width a 3120 along x-axis 602. Note that the rectangular geometry includes the case of a square geometry (length b 3130 equal to width a 3120). The ground plane 3102 may be larger than the radiating element 3104.

Capacitive elements comprising SLSs are located on all four edges of radiating patch 3104. SLS 3108 and SLS 3110 are located along the two edges of the radiating element 3104 parallel to the y-axis 604. SLS 3120 and SLS 3122 are located along the two edges of the radiating element 3104 parallel to the x-axis 602. In the embodiment shown in FIG. 31, the localized structures have a height c 3140. The height c 3140 is measured along the z-axis 606.

The field of circular polarization is a sum of two linear polarizations, orthogonal to each other and shifted in phase by 90 degrees. To excite this field, two rods are used, rod 3106 and rod 3107. The location of rod 3107 is shifted from the geometrical center of radiating element 3104 along the x-axis 602. The location of rod 3106 is shifted from the geometrical center of radiating element 3104 along the y-axis 604. The x-z plane is the E-plane for the field excited by rod 3107 and the H-plane for the field excited by rod 3106. For the field excited by rod 3107, SLS 3108 and SLS 3110 are aligned along the magnetic field vector (in the H-plane). SLS 3120 and SLS 3122 are aligned along the electric field vector (in the E-plane). Similarly, for the field excited by rod 3106, SLS 3108 and SLS 3110 are aligned along the electric field vector (in E-plane). SLS 3120 and SLS 3122 are aligned along the magnetic field vector (in H-plane).

To estimate the frequency performance of the circularly-polarized antenna shown in FIG. 31, the frequency performance for each linear polarization needs to be analyzed. The circularly-polarized antenna may be characterized by the equivalent circuit shown in FIG. 28. The E-field of linear polarization excited by, for example, rod 3107 is oriented along the x-axis 602. Then, SLS 3122, aligned along the x-axis 602, is modelled by a system of capacitances $C_1$. SLS 3108, aligned along the y-axis 604, is modelled by a total capacitance $C_2$. Similar considerations apply for the E-field excited by rod 3106.

Figure 28:
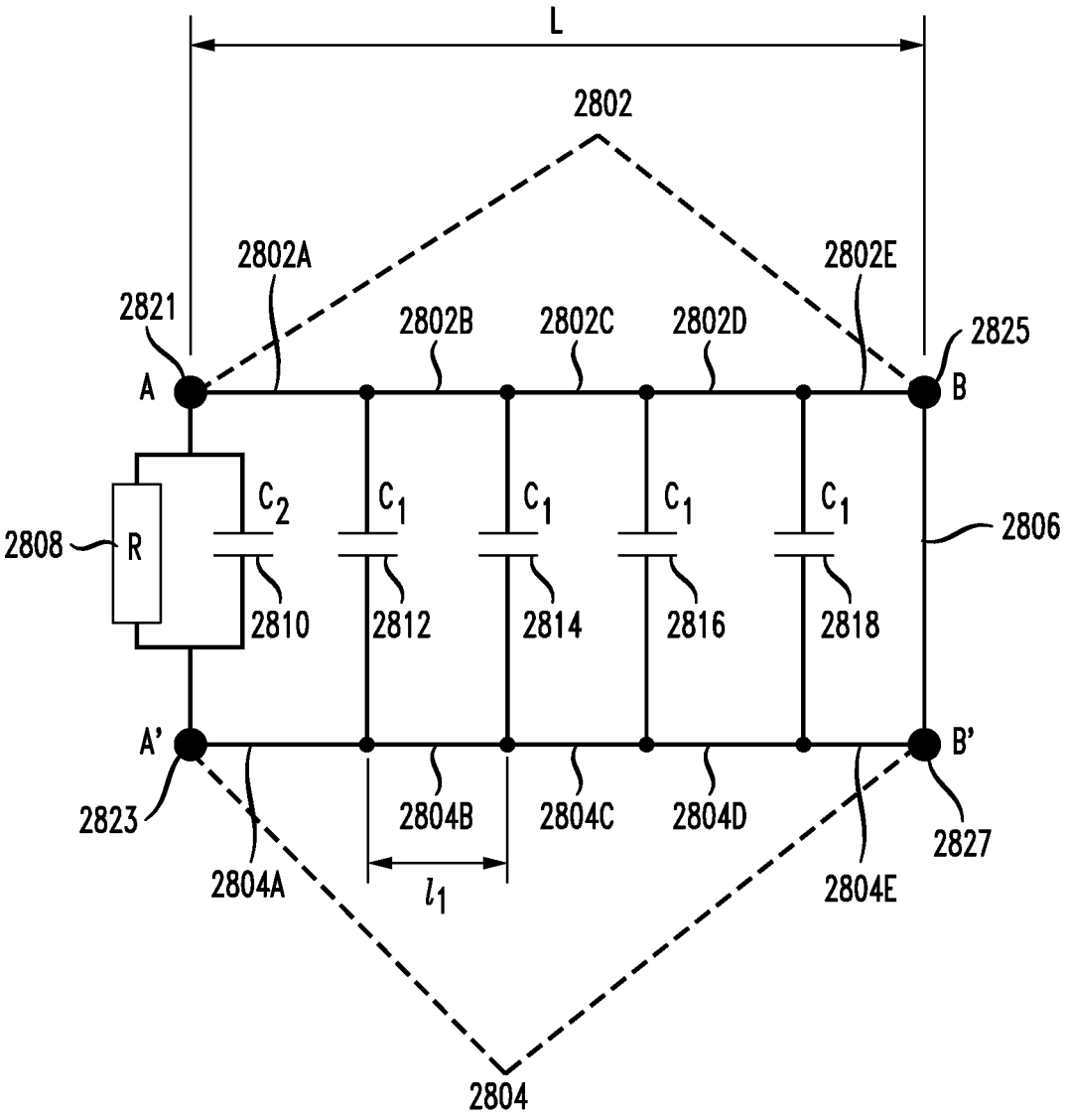
FIG. 28 shows an equivalent circuit of a circularly-polarized antenna modelled as multiple microstrip line segments.
Figure 29:
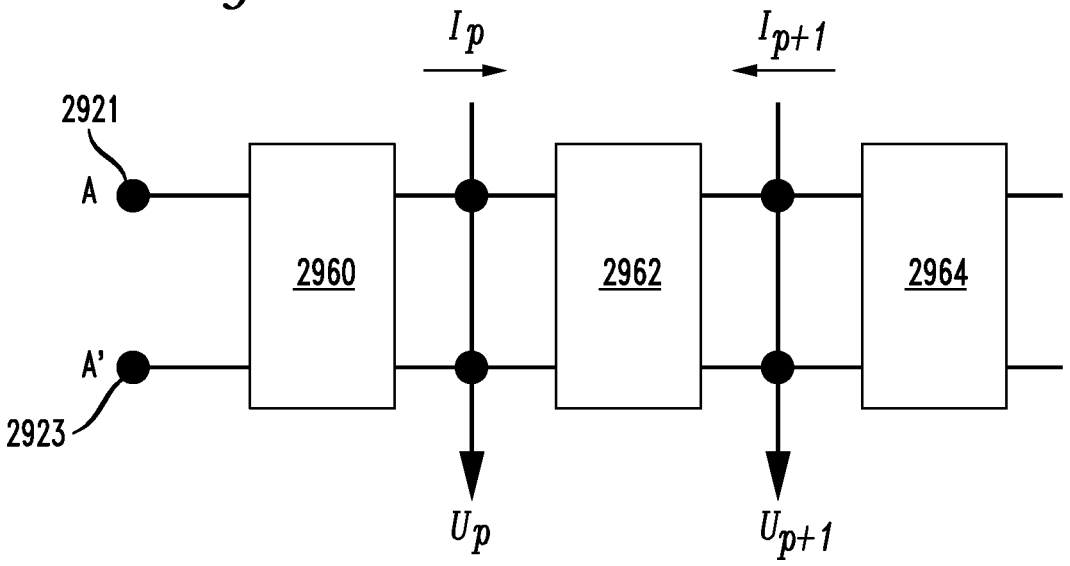
FIG. 29 shows a chain structure of four-pole devices for the equivalent circuit of a circularly-polarized antenna model.
Figure 30:
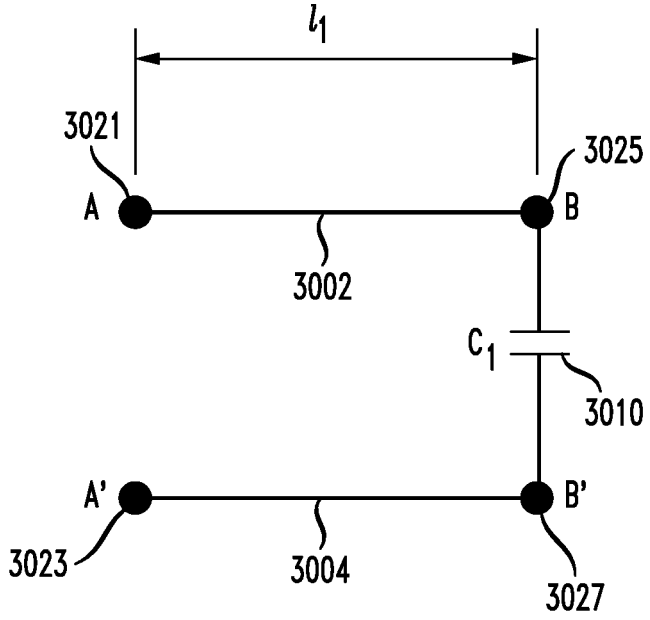
FIG. 30 shows a four-pole device comprising a transmission line.

The equivalent circuit for a circularly-polarized antenna is shown in FIG. 28. The two sides of the strip line, with length L, are line 2802 (running from node A 2821 to node B 2825) and line 2804 (running from node A' 2823 to node B' 2827). Line 2802 comprises line segment 2802A-line segment 2802E. Line 2804 comprises line segment 2804A-line segment 2804E. The system of capacitances $C_1$ (comprising capacitance 2812-capacitance 2818) extending along the x-axis 602, with an increment $l_1$, is equivalent to the total line wave-slowing $\beta_1$ factor. The system of capacitance 2810 extending along the y-axis 604 is equivalent to the total capacitance $C_2$. When dispersion is present (frequency is a function of $\beta_1$), there is an undesirable increase of the Q-factor. To estimate the value of the wave-slowing factor $\beta_1$ and the value of the increment $l_1$ at which dispersion becomes significant, an equivalent circuit comprising a series of four-pole devices (four-pole device 2960-four-pole device 2964) is used (FIG. 29). An individual four-pole device is shown in FIG. 30. The nodes are node A 3021, node A' 3023, node B 3025, and node B' 3027. It includes a strip line with length $l_1$, a wave resistance W corresponding to an air dielectric medium, a propagation constant $\gamma$, and a capacitance $C_1$ 3010. The elements of the corresponding conductivity matrix are given by:

$$y_{11} = \frac{-i}{W} ctg\gamma l_1 \tag{E22}$$

-continued $$y_{22} = \frac{-i}{W} ctg\gamma l_1 + i\omega C_1$$

$$y_{12} = y_{21} = \frac{i}{W \sin\gamma l_1},$$

where $y_{i,j}$ are the elements of the conductivity matrix.

In the equivalent circuit shown in FIG. 29, there is a traveling wave, and the phase incursion between two neighboring four-pole devices is $\phi$. [Phase incursion is the difference between the phases of $I_{p+1}$ and $I_p$ and between the phases of $U_{p+1}$ and $U_p$, which are defined below.] The following set of equations holds:

$$\begin{cases} I_p = U_p y_{11} + U_{p+1} y_{12} \\ I_{p+1} = U_p y_{21} + U_{p+1} y_{22} \end{cases} \quad \text{(E23)}$$

$$\begin{cases} U_{p+1} = U_p e^{-i\varphi} \\ I_{p+1} = -I_p e^{-i\varphi} \end{cases}$$

where $I_p$ and $I_{p+1}$ are the equivalent currents and $U_p$ and $U_{p+1}$ are the corresponding equivalent voltages at the nodes of the four-pole devices (FIG. 29).

Therefore, $$U_p y_{21} + U_p e^{-i\varphi} y_{22} = -(U_p y_{11} + U_p e^{-i\varphi} y_{12}) e^{-i\varphi} \quad \text{(E24)}$$

and $$\cos\varphi = -\frac{y_{11} + y_{22}}{2y_{12}}. \quad \text{(E25)}$$

The result is $$\cos\varphi = \cos\gamma l_1 - \frac{\omega C_1 W \sin\gamma l_1}{2} \quad \text{(E26)}$$

The phase incursion $\phi$ may be interpreted in terms of equivalent wave-slowing factor $\beta$:

$$\varphi = \frac{\omega}{c} \beta_1 l_1. \quad \text{(E27)}$$

Mathematical calculations according to (E22)-(E27) show that dispersion increases as the wave-slowing factor $\beta_1$ and the increment $l_1$ increase. To obtain a frequency-independent wave-slowing factor on the order of ~4-5, the increment value is ~0.07 of the wavelength, or less. Following an analysis similar to that used in similar to (E14)-(E20), an estimate of the Q-factor for the equivalent circuit in FIG. 28 is given by:

$$Q = \frac{1}{4} \frac{\lambda_0}{h} \beta_1 \left[ \frac{2}{\pi} ctg\left(\frac{\pi}{2\beta_2}\right) + \frac{1}{\sin^2\left(\frac{\pi}{2\beta_2}\right)} \frac{1}{\beta_2} \right] \quad \text{(E28)}$$

$$\beta = \beta_1 \beta_2, \quad \text{(E29)}$$

where $\beta$ is the full-wave slowing factor and $\beta_2$ is the contribution of capacitance $C_2$ to wave-slowing. At sufficiently large values of $\beta_2$ ($\beta_2 \geq 1.5$), the following approximation holds:

$$Q \approx \frac{1}{4} \frac{\lambda_0}{h} \frac{8}{\pi^2} \beta_1 \beta_2. \quad \text{(E30)}$$

Therefore, a gain in bandwidth compared with a solid dielectric medium still holds true in this case as well.

Figure 32:
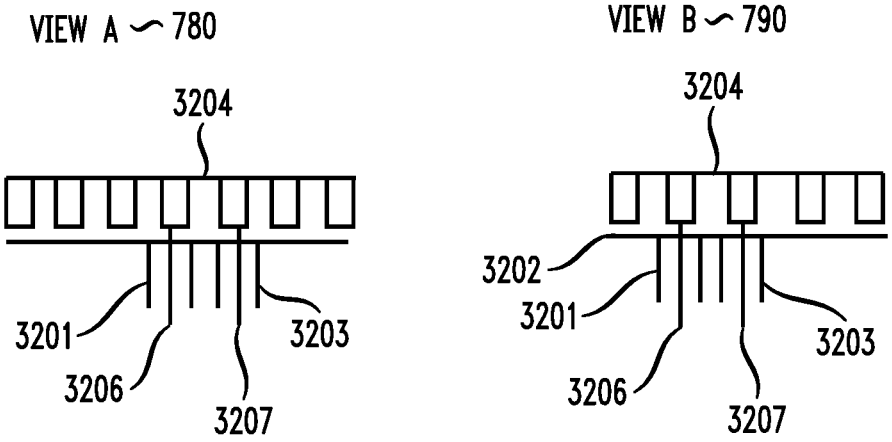
FIG. 32-FIG. 35 show schematics of a circularly-polarized antenna with various configurations of capacitive elements comprising a series of localized structures.
Figure 33:
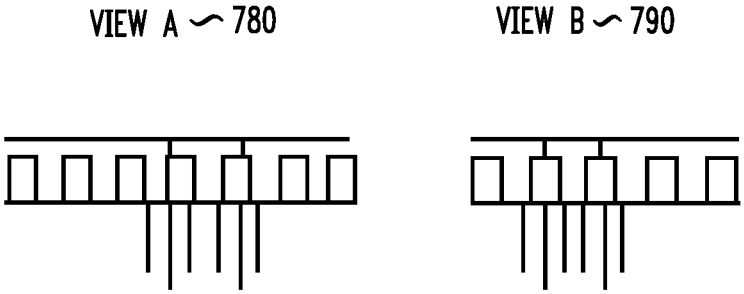
Figure 34:
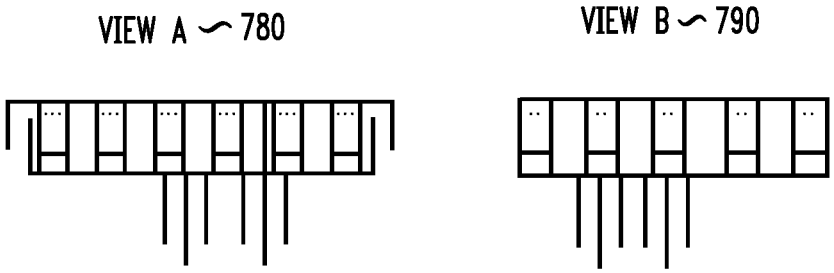
Figure 35:
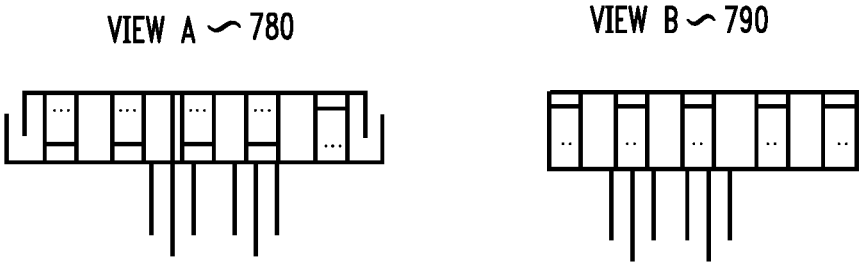

FIG. 32-FIG. 35 and FIG. 37-FIG. 42 illustrate embodiments with different combinations, shapes, and locations of SLSs. In FIG. 32-FIG. 35 and FIG. 37-FIG. 42, two views are shown. Referring to FIG. 31, View A 780 is the view along the (+) direction of y-axis 604. View B 790 is the view along the (−) direction of x-axis 602. The geometries are similar to those previously illustrated in FIG. 17-FIG. 27, except the SLSs are located on all four edges of the radiating element or ground plane. FIG. 32 shows the components common to all the embodiments shown in FIG. 32-FIG. 35 and FIG. 37-FIG. 42. The antenna includes ground plane 3202 and radiating element 3204, which is fed by two coaxial cables, one with center conductor 3206 and outer conductor 3201, and the other with center conductor 3207 and outer conductor 3203.

Figure 43:
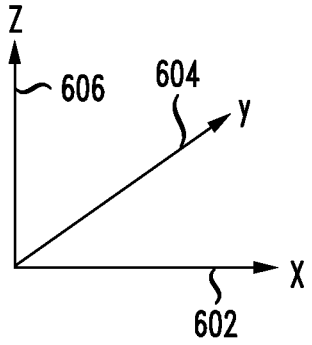
FIG. 43 shows a schematic of a micropatch antenna with a low-noise amplifier on a printed circuit board mounted on the radiating element.
Figure 43:
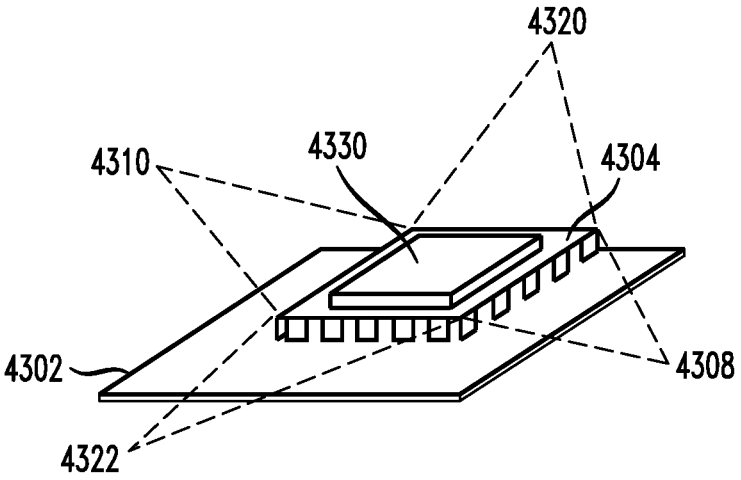

FIG. 43 shows an embodiment of a stacked micropatch antenna comprising ground plane 4302 and radiating element 4304. An auxiliary electronic assembly may be integrated with the micropatch antenna. Low-noise amplifier 4430, for example, may be assembled on a printed circuit board, which is then mounted on top of radiating element 4304. The capacitive elements (SLS 4308, SLS 4310, SLS 4320, and SLS 4322) are series of localized structures located along all four edges of radiating element 4304, which has a rectangular geometry. Other configurations of capacitive elements, as described above, may also be used.

Figure 44:
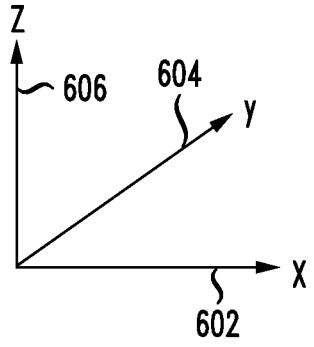
FIG. 44 shows a schematic of a dual-band micropatch antenna.
Figure 44:
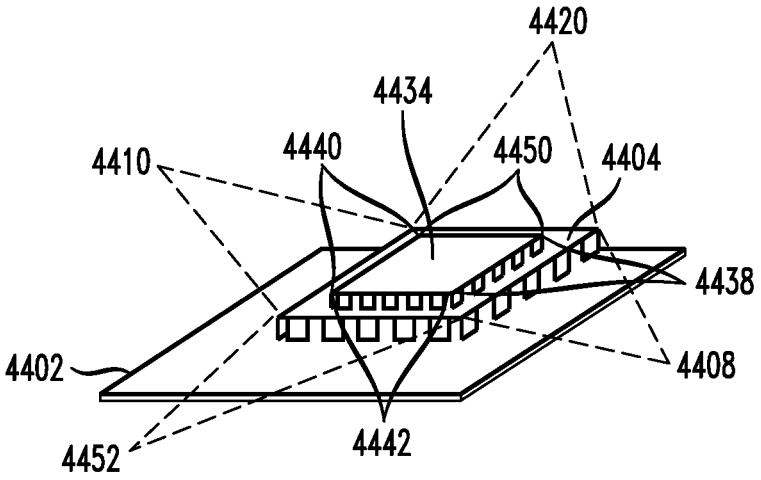

FIG. 44 shows an embodiment of a dual-band micropatch antenna comprising a ground plane 4402 and two radiating elements, radiating element 4404 and radiating element 4434. Radiating element 4404 and ground plane 4402 comprise a micropatch antenna for receiving and transmitting signals in a low-frequency band. Radiating element 4404 also serves as a ground plane for radiating element 4434. Radiating element 4434 and radiating element 4404 comprise an antenna for transmitting signals in a high-frequency band. Capacitive elements SLS 4408, SLS 4410, SLS 4420, and SLS 4452 are series of localized structures located along all four edges of radiating element 4404, which has a rectangular geometry. Capacitive elements SLS 4438, SLS 4440, SLS 4442, and SLS 4450 are series of localized structures located along all four edges of radiating element 4434, which has a rectangular geometry. Other configurations of capacitive elements, as described above, may also be used.

Figure 47:
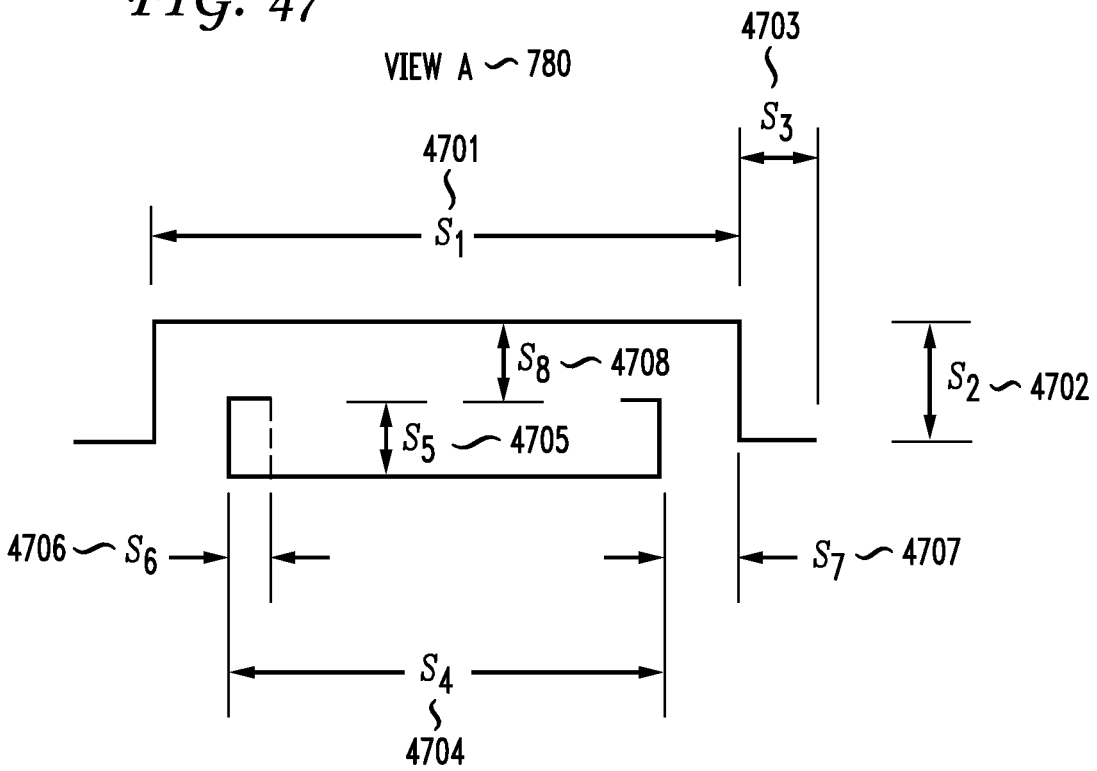
FIG. 47 shows a set of design parameters for a specific configuration of capacitive elements.

A radiating element or ground plane with capacitive elements comprising extended continuous structures may be fabricated from a single piece of sheet metal by bending the edges appropriately, as shown in FIG. 45A-FIG. 45C, for example. Similarly, a radiating element or ground plane with capacitive elements comprising a series of localized structures, as shown in FIG. 46 for example, may be fabricated from a single piece of sheet metal. A series of notches are first cut from the edges of the sheet metal, leaving a series of tabs, which are then bent into the desired geometry. All relevant dimensions may be user-defined to adapt the geometry for specific applications. For example, in the geometric configuration shown in FIG. 47, dimensions $s_1$ 4701-$s_8$ 4708 may be user-defined.

In the embodiments shown in FIG. 8-FIG. 15 and FIG. 17-FIG. 27, the capacitive elements are located along the perimeter of the rectangular radiating element, along the perimeter of the ground plane, or along the perimeter of the rectangular radiating element and the perimeter of the ground plane. Herein, the term perimeter refers to both linear and curvilinear boundaries of a geometrical shape or region. For example, the perimeter of a rectangular region refers to the four edges (sides) of the rectangle, and the perimeter of a circular region refers to the circumference of the circle. Note that a perimeter is referenced to a specific geometrical region. In examples below, one geometrical region may be enclosed by a second geometrical region. For example, a circular region may be enclosed by a larger rectangular region. In this instance, there are two perimeters of interest: the perimeter (circumference) of the inner circular region and the perimeter (four edges) of the outer rectangular region.

Figure 48A:
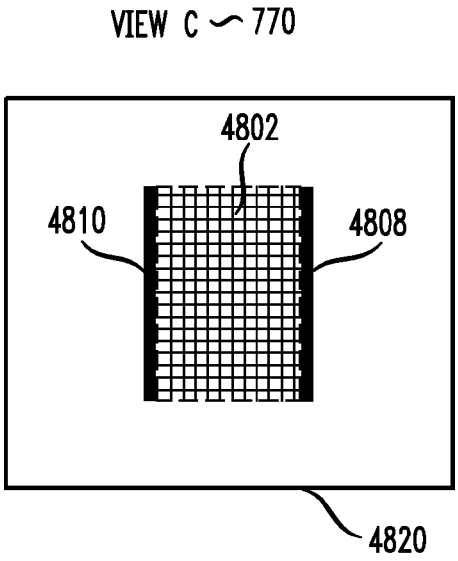
FIG. 48A-FIG. 48D show schematics of extended continuous structures and series of localized structures on oversize ground planes.
Figure 48B:
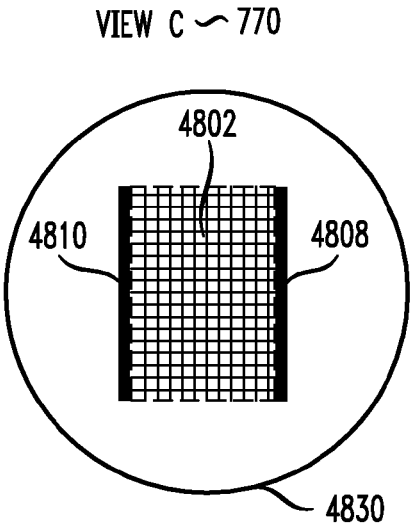
Figure 48C:
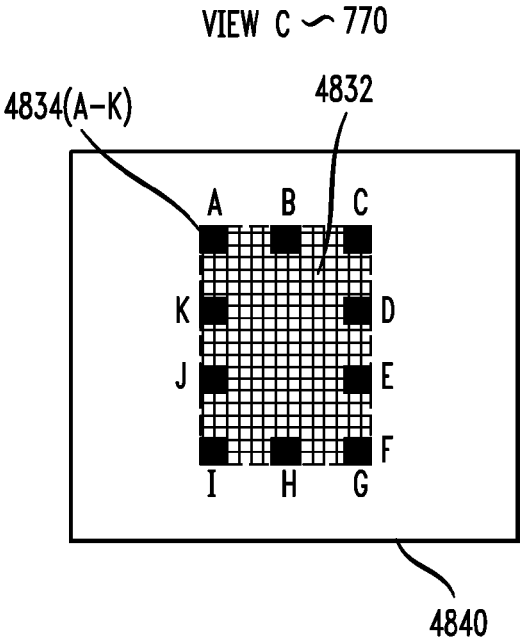
Figure 48D:
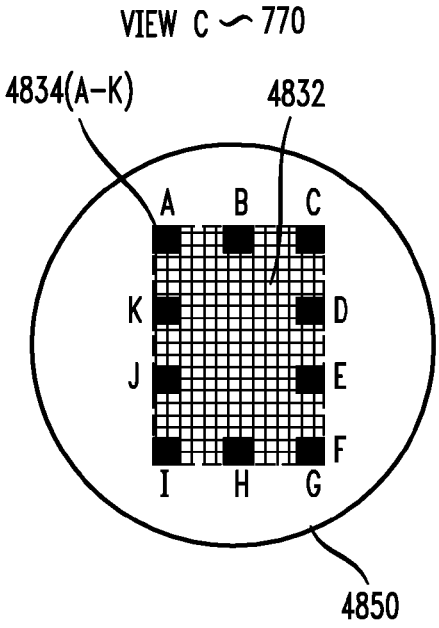

In other embodiments of the invention, capacitive elements may be configured within a larger ground plane, wherein the size of the ground plane is larger than the size of the radiating element. FIG. 48A-FIG. 48D show examples of specific ground-plane geometries. Referring to FIG. 7, View C 770 is the view along the (−) direction of z-axis 606. In FIG. 48A, capacitive elements ECS 4808 and ECS 4810 are located within (enclosed by) rectangular ground plane 4820. Region 4802 is a region enclosed by a rectangle with sides along ECS 4808 and ECS 4810. In FIG. 48B, capacitive elements ECS 4808 and ECS 4810 are located within circular ground plane 4830. In FIG. 48C, capacitive elements SLS 4834 (A-K) are configured along the perimeter of rectangular region 4832. Capacitive elements SLS 4834 (A-K) are located within rectangular ground plane 4840. In FIG. 48D, capacitive elements SLS 4834 (A-K) are located within circular ground plane 4850. Herein, if the capacitive elements are located within (enclosed by) a larger ground plane, the ground plane is referred to as an oversize ground plane. The capacitive elements are located within the perimeter of the oversize ground plane. Herein, an oversize ground plane in a micropatch antenna is larger than the radiating element in a micropatch antenna. One skilled in the art may use other geometrical shapes for the oversize ground plane adapted for specific applications.

Figure 49:
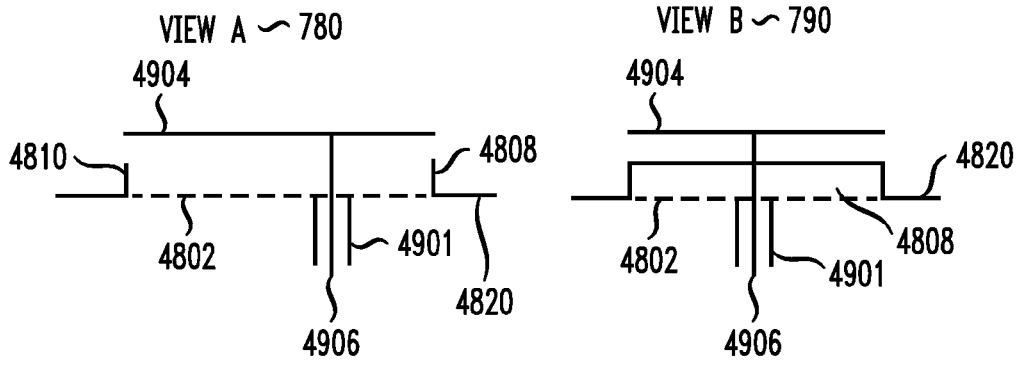
FIG. 49 and FIG. 50 show schematics of linearly-polarized antennas with extended continuous structures on oversize ground planes.
Figure 50:
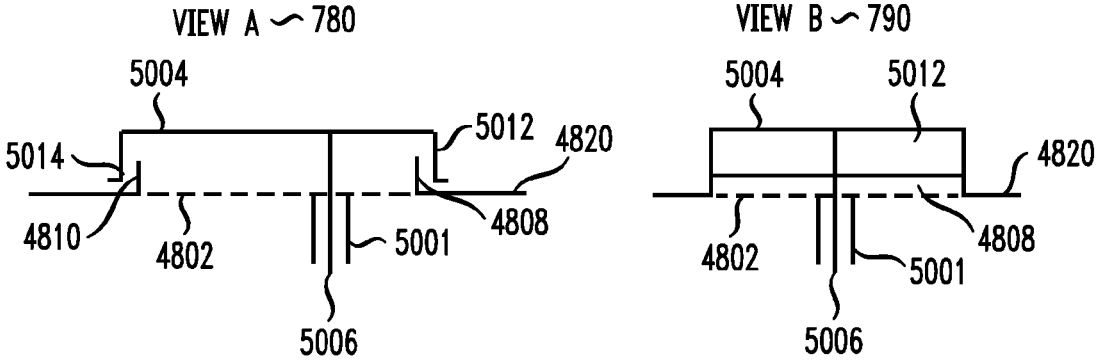

FIG. 49 and FIG. 50 show examples of linearly-polarized antennas with oversize ground planes. The views shown are View A 780 and View B 790. The configuration in FIG. 49 and FIG. 50 use the ground-plane geometry of FIG. 48A (View C 770). In FIG. 49 and FIG. 50, the components corresponding to the ones shown in FIG. 48A are labelled by the reference numbers from FIG. 48.

The design shown in FIG. 49 is similar to the design shown in FIG. 9, except for the ground-plane geometry. In FIG. 9, the antenna includes ground plane 902 and radiating element 904, which is fed by a coaxial cable with center conductor 906 and outer conductor 901. ECS 908 and ECS 910 are oriented parallel to the H-plane 608 and are located along the two edges of the ground plane 902 parallel to the y-axis 604. ECS 908 and ECS 910 are both straight ECSs. In FIG. 49, the antenna includes oversize ground plane 4820 and radiating element 4904, which is fed by a coaxial cable with center conductor 4906 and outer conductor 4901. ECS 4808 and ECS 4810 are oriented parallel to the H-plane 608 and are located within the oversize ground plane 4820 parallel to the y-axis 604. ECS 4808 and ECS 4810 are both straight ECSs. Note that region 4802 (a portion of oversize ground plane 4820) in FIG. 48A and FIG. 49 corresponds to the ground-plane region 902 in FIG. 9.

The design shown in FIG. 50 is similar to the design shown in FIG. 14, except for the ground-plane geometry. In FIG. 14, the antenna includes ground plane 1402 and radiating element 1404, which is fed by a coaxial cable with center conductor 1406 and outer conductor 1401. ECS 1412 and ECS 1414 are oriented parallel to the H-plane 608 and are located along the two edges of the radiating element 1404 parallel to the y-axis 604. ECS 1408 and ECS 1410 are oriented parallel to the H-plane 608 and are located along the two edges of the ground plane 1402 parallel to the y-axis 604. ECS 1408 and ECS 1410 are located partially within the region between ECS 1412 and ECS 1414. ECS 1408 and ECS 1410 are both straight ECSs. ECS 1412 and ECS 1414 are both outwardly-bent ECSs. In FIG. 50, the antenna includes oversize ground plane 4820 and radiating element 5004, which is fed by a coaxial cable with center conductor 5006 and outer conductor 5001. ECS 5012 and ECS 5014 are oriented parallel to the H-plane 608 and are located along the two edges of the radiating element 5004 parallel to the y-axis 604. ECS 4808 and ECS 4810 are oriented parallel to the H-plane 608 and are located within the oversize ground plane 4820 parallel to the y-axis 604. ECS 4808 and ECS 4810 are located partially within the region between ECS 5012 and ECS 5014. ECS 4808 and ECS 4810 are both straight ECSs. ECS 5012 and ECS 5014 are both outwardly-bent ECSs. Note that region 4802 (a portion of oversize ground plane 4820) in FIG. 48A and FIG. 49 corresponds to the ground-plane region 1402 in FIG. 14.

Figure 51A:
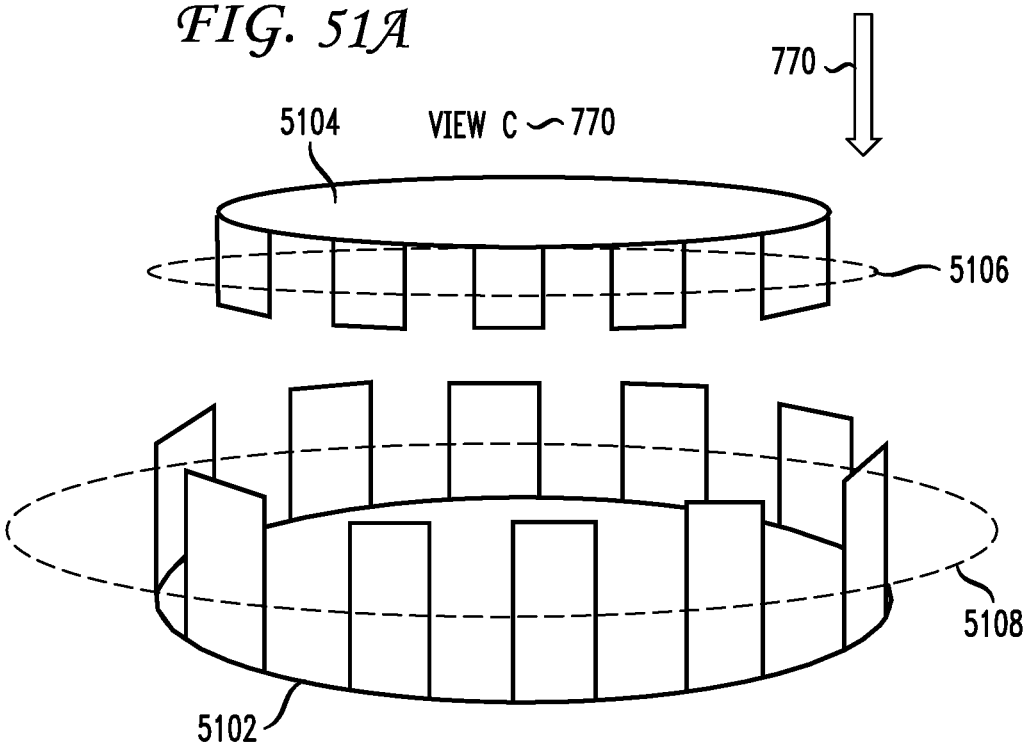
FIG. 51A and FIG. 51B show schematics of a circularly-polarized antenna with a circular radiating element and a circular ground plane.
Figure 51B:
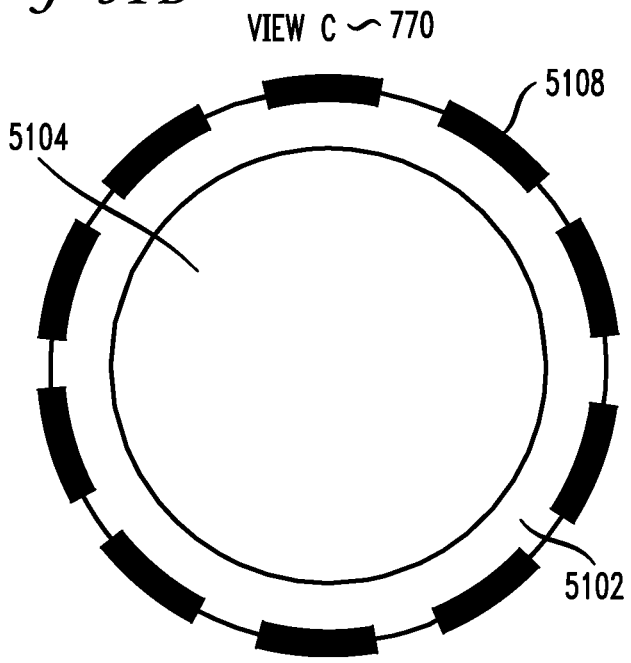

In the embodiments discussed above, the radiating element and the ground plane have rectangular geometries. In the embodiment shown in FIG. 51A and FIG. 51B, a radiating element and a ground plane with circular geometries are used for circularly-polarized radiation. To simplify the figures, the coaxial cable feeding the antenna is not shown. FIG. 51 A and FIG. 51B show two different views of circular radiating element 5104 and circular ground plane 5102. Capacitive elements comprise a circular array of localized structures 5106 along the perimeter (circumference) of radiating element 5104, and a circular array of localized structures 5108 along the perimeter (circumference) of ground plane 5102. FIG. 51A shows an exploded view, in which radiating element 5104 and ground plane 5102 are separated to illustrate details. In the actual assembly, as shown in FIG. 51B, the diameter of ground plane 5102 is larger than the diameter of radiating element 5104, and the circular array of localized structures 5106 is located partially within the region enclosed by the circular array of localized structures 5108. For the localized structures in the circular array of localized structures, the various geometries similar to those configured for the series of localized structures shown in FIG. 32-FIG. 42 may be used.

Figure 36A:
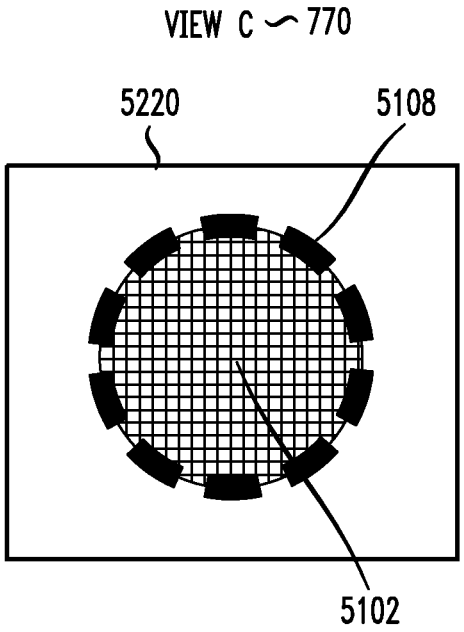
FIG. 36A and FIG. 36B show schematics of a circular array of localized structures on oversize ground planes.
Figure 36B:
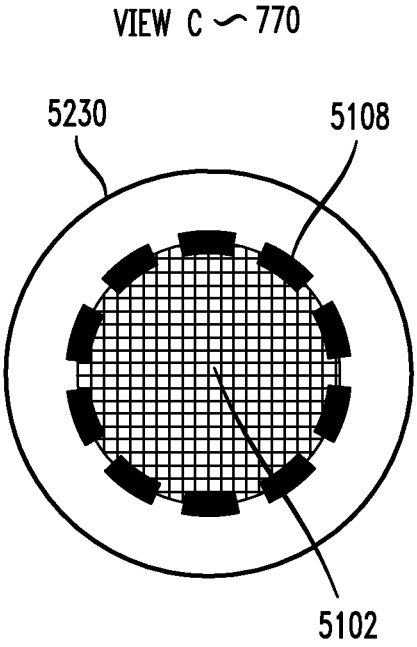
Figure 37:
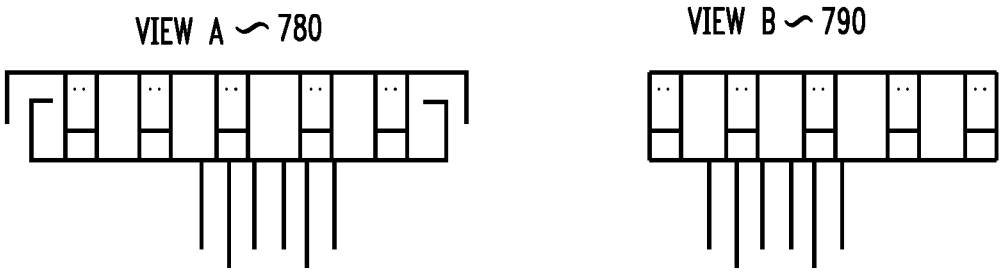
FIG. 37-FIG. 42 show schematics of a circularly-polarized antenna with various configurations of capacitive elements comprising a series of localized structures.
Figure 38:
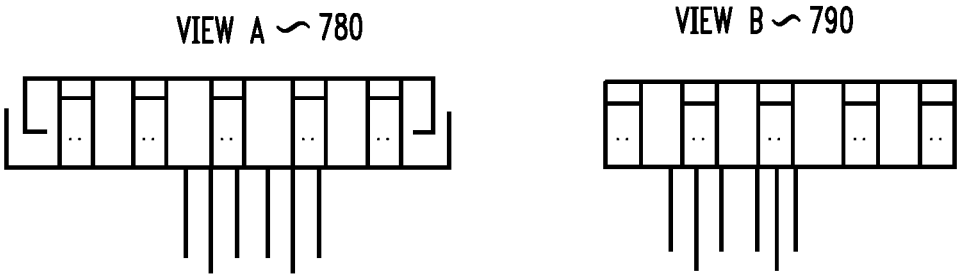
Figure 39:
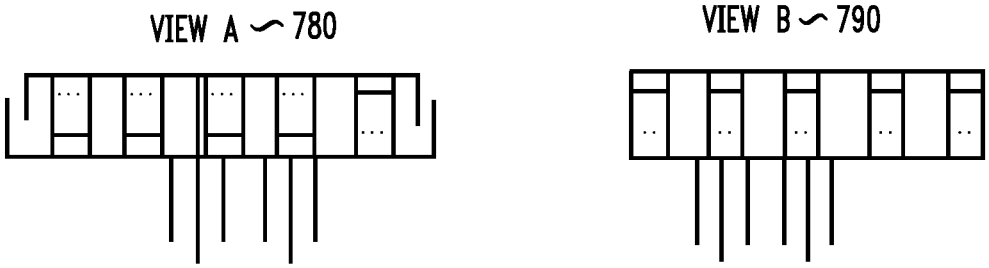
Figure 40:
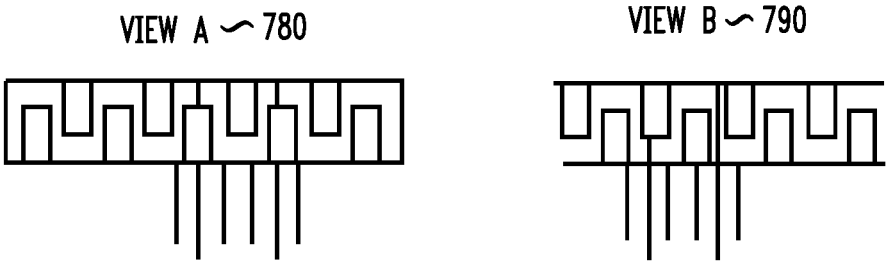
Figure 41:
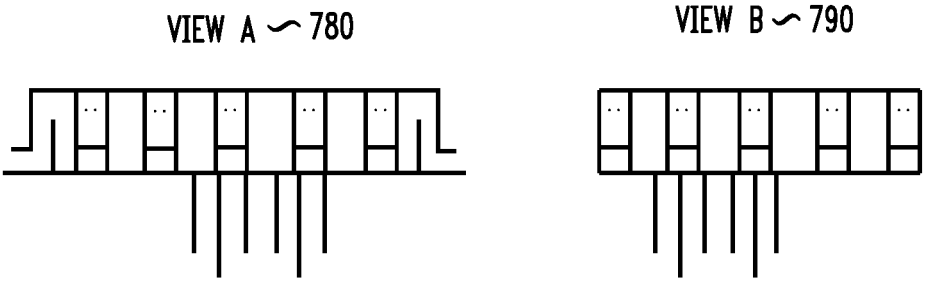
Figure 42:
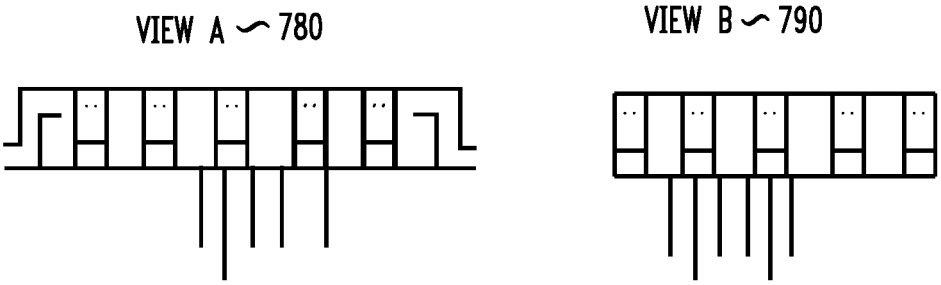

Oversize ground planes may also be used for antennas with a circular geometry. In FIG. 36A, the circular array of localized structures 5108 (FIG. 51) is located within oversize rectangular ground plane 5220. Region 5102 (FIG. 36A), enclosed by the circular array of localized structures 5108, represents the same region as ground plane 5102 in FIG. 51A and FIG. 51B. In FIG. 36B, the circular array of localized structures 5108 is located within oversize circular ground plane 5230.

Herein, a set of capacitive elements refer to a user-specified group of one or more capacitive elements. A set of capacitive elements, for example, may refer to a group of one or more extended continuous structures, a group of one of more series of localized structures, and a group of one or more circular arrays of localized structures.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A circularly-polarized micropatch antenna comprising:

a radiating element comprising a first circular region having a first circumference;

a ground plane comprising a second circular region having a second circumference greater than the first circumference, wherein the second circular region is enclosed by an outer region having an outer perimeter;

an air gap between the radiating element and the ground plane;

a first set of capacitive elements consisting of a first circular array of localized structures disposed along the first circumference; and a second set of capacitive elements consisting of a second circular array of localized structures disposed along the second circumference;

wherein:

a portion of each of the capacitive elements in the first set of capacitive elements is enclosed by the second set of capacitive elements;

there are no other capacitive elements disposed on the radiating element; and there are no other capacitive elements disposed on the ground plane.

2. The circularly-polarized micropatch antenna of claim 1, wherein the outer perimeter has a circular geometry.

3. The circularly-polarized micropatch antenna of claim 1, wherein the outer perimeter has a square geometry.

4. The circularly-polarized antenna of claim 1, further comprising:

an auxiliary electronic assembly mounted on the radiating element.

5. The circularly-polarized antenna of claim 4, wherein the auxiliary electronic assembly comprises:

a printed circuit board; and a low-noise amplifier.

6. A circularly-polarized micropatch antenna comprising:

a radiating element comprising a first square region having a first perimeter, wherein:

the first perimeter comprises a first edge, a second edge, a third edge, and a fourth edge; and each of the first edge, the second edge, the third edge, and the fourth edge has a first length;

a ground plane comprising a second square region having a second perimeter, wherein the second square region is enclosed by an outer region having an outer perimeter, wherein:

the second perimeter comprises a fifth edge, a sixth edge, a seventh edge, and an eighth edge;

each of the fifth edge, the sixth edge, the seventh edge, and the eighth edge has a second length greater than the first length; and the fifth edge is parallel to the first edge;

an air gap between the radiating element and the ground plane;

a first set of capacitive elements consisting of:

a first series of localized structures disposed along the first edge;

a second series of localized structures disposed along the second edge;

a third series of localized structures disposed along the third edge; and a fourth series of localized structures disposed along the fourth edge; and a second set of capacitive elements consisting of:

a fifth series of localized structures disposed along the fifth edge;

a sixth series of localized structures disposed along the sixth edge;

a seventh series of localized structures disposed along the seventh edge; and an eighth series of localized structures disposed along the eighth edge;

wherein:

a portion of each of the capacitive elements in the first set of capacitive elements is enclosed by the second set of capacitive elements;

there are no other capacitive elements disposed on the radiating element; and there are no other capacitive elements disposed on the ground plane.

7. The circularly-polarized micropatch antenna of claim 6, wherein the outer perimeter has a square geometry.

8. The circularly-polarized micropatch antenna of claim 6, wherein the outer perimeter has a circular geometry.

9. The circularly-polarized antenna of claim 6, further comprising:

an auxiliary electronic assembly mounted on the radiating element.

10. The circularly-polarized antenna of claim 9, wherein the auxiliary electronic assembly comprises:

a printed circuit board; and a low-noise amplifier.

* * * * *